US012523223B1

(12) United States Patent
Auken

(10) Patent No.: US 12,523,223 B1
(45) Date of Patent: Jan. 13, 2026

(54) BALANCED ROLLING PISTON COMPRESSOR WITH CENTRAL MASS REDUCTIONS FOR IMPROVED COMPRESSOR STABILITY

(71) Applicant: MAHLE INTERNATIONAL GMBH, Stuttgart (DE)

(72) Inventor: Corey Van Auken, Buffalo, NY (US)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 18/889,930

(22) Filed: Sep. 19, 2024

(51) Int. Cl.

| | |
|---|---|
| ***F04C 18/356*** | (2006.01) |
| ***F04C 23/02*** | (2006.01) |
| ***F04C 29/12*** | (2006.01) |
| *F25B 31/02* | (2006.01) |

(52) U.S. Cl.
CPC ..... *F04C 18/3562* (2013.01); *F04C 23/02* (2013.01); *F04C 29/12* (2013.01); *F25B 31/026* (2013.01)

(58) Field of Classification Search
CPC ..... F04C 18/3562; F04C 23/02; F04C 29/12; F25B 31/026
See application file for complete search history.

(56) References Cited

U.S. PATENT DOCUMENTS

| | | | | |
|---|---|---|---|---|
| 4,627,861 | A | 12/1986 | Ibaraki et al. | |
| 4,900,237 | A * | 2/1990 | Reedy | F04C 29/0085 366/128 |
| 4,915,554 | A | 4/1990 | Serizawa et al. | |
| 5,074,761 | A * | 12/1991 | Hirooka | F04C 28/12 417/310 |
| 5,230,616 | A | 7/1993 | Serizawa et al. | |
| 7,722,343 | B2 * | 5/2010 | Hirayama | F04C 18/356 418/94 |
| 9,261,094 | B2 * | 2/2016 | Hugenroth | F04C 18/38 |
| 9,267,503 | B2 * | 2/2016 | Hugenroth | A61M 16/0057 |
| 10,550,843 | B2 * | 2/2020 | Tanaka | F04C 18/07 |
| 10,851,782 | B2 * | 12/2020 | Ashimori | F04C 29/0021 |
| 11,629,713 | B1 * | 4/2023 | Haseley | F04C 29/026 418/55.6 |

(Continued)

FOREIGN PATENT DOCUMENTS

| | | |
|---|---|---|
| CN | 2867222 Y | 2/2007 |
| CN | 201436388 U | 10/2010 |

(Continued)

*Primary Examiner* — Jesse S Bogue
(74) *Attorney, Agent, or Firm* — Endurance Law Group PLC; James R. Yee

(57) ABSTRACT

An electric compressor includes a housing and a compression device. The housing defines an intake volume and a discharge volume. The compression device is a rotary-type compression device configured to compress refrigerant. The compression device includes a piston device including a cylinder and a rolling piston. The cylinder is eccentrically coupled to a drive shaft. The rolling piston has an outer surface in contact with an inner surface of a compression chamber. The rolling piston rotates about the cylinder as the drive shaft and the piston device are rotated by a motor. A vane moveably coupled to the housing and having an end adjacent the compression chamber is biased such that the end of the vane is in contact with the rolling piston as the piston device is rotated by the drive shaft.

22 Claims, 13 Drawing Sheets

(56) References Cited

U.S. PATENT DOCUMENTS

| | | | | |
|---|---|---|---|---|
| 11,655,820 | B2 * | 5/2023 | Lee | F04C 29/028 417/410.3 |
| 12,203,472 | B2 * | 1/2025 | Latham | F04C 28/08 |
| 2006/0140791 | A1 * | 6/2006 | Deming | F04C 18/3564 417/410.3 |
| 2011/0271699 | A1 * | 11/2011 | Lee | F04C 28/24 62/228.4 |
| 2018/0023567 | A1 * | 1/2018 | Tanaka | F01C 21/0881 418/150 |
| 2023/0019752 | A1 * | 1/2023 | Park | F04B 39/123 |

FOREIGN PATENT DOCUMENTS

| | | | |
|---|---|---|---|
| CN | 201599173 | U | 10/2010 |
| CN | 202867222 | U | 4/2013 |
| CN | 104728119 | A | 6/2015 |
| CN | 205503458 | U | 8/2016 |
| CN | 207049000 | U | 2/2018 |
| CN | 209370003 | U | 9/2019 |
| CN | 210423012 | U | 4/2020 |
| EP | 3650699 | A1 | 5/2020 |
| EP | 3696416 | A1 | 8/2020 |
| JP | S5768583 | A | 4/1982 |
| JP | H4175490 | A | 6/1992 |
| JP | H07310662 | A | 11/1995 |
| JP | 2628747 | B2 | 7/1997 |
| JP | 4325081 | B2 | 9/2009 |
| JP | 4964288 | B2 | 6/2011 |
| JP | 5346210 | B2 | 11/2013 |
| JP | 2014129755 | A | 7/2014 |
| JP | 5575033 | B2 | 8/2014 |
| JP | 5679796 | B2 | 3/2015 |
| JP | 2016114049 | A | 6/2016 |
| JP | 2016173079 | A * | 9/2016 |
| KR | 19980078114 | | 11/1998 |
| KR | 20010026315 | A | 4/2001 |
| KR | 20010027580 | A | 4/2001 |
| KR | 200284265 | Y1 | 8/2002 |
| KR | 102210269 | B1 | 2/2021 |
| WO | 2019220529 | A1 | 11/2019 |
| WO | 2022153482 | A1 | 7/2022 |
| WO | 2022224420 | A1 | 10/2022 |
| WO | 2023170869 | A1 | 9/2023 |

* cited by examiner

BALANCED ROLLING PISTON COMPRESSOR WITH CENTRAL MASS REDUCTIONS FOR IMPROVED COMPRESSOR STABILITY

FIELD OF THE INVENTION

The invention relates generally to electric compressors, and more particularly to an electric compressor that compresses a refrigerant using a rolling piston.

BACKGROUND OF THE INVENTION

Compressors have long been used in cooling systems. Rotary compressors typically use a rotating drive shaft and a compression device connected to the drive shaft that rotates with the drive shaft to compress refrigerant. For example, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to provide air-conditioning. Such compressors may also be used, in reverse, in applications requiring a heat pump. Generally, these compressors are driven using rotary motion derived from the automobile's engine. Other types of rotary compressors, such as a reciprocating-type compressor have also been used.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compart of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade the battery and/or other system. It may also be used to cool the battery during times when the battery is not being charged or used, as heat may damage or degrade the battery. Since the electric compressor may be run at various times, even when the motor vehicle is not in operation, such use, requires electrical energy from the battery, thus reducing the operating time of the battery.

Rotary-driven compression devices must be balanced in order to reduce noise and vibration and to maximize the efficiency and operating life of the compressor.

It is thus desirable to provide an electric compressor having high efficiency, low-noise and maximum operating life. The present invention is aimed at one or more of the problems or advantages identified above.

BRIEF SUMMARY OF THE INVENTION

In one aspect of the present invention, a compressor has a compression device for compressing a refrigerant. The compressor operates via rotation of the compression device within a compression chamber. The compression device includes a piston device having a cylinder and a rolling piston configured to rotate on the cylinder. The rolling piston being in contact with an inner surface of the compression chamber and, with a vane, forming sub-chamber(s) in which the refrigerant is compressed as the piston device is rotated within the compression chamber.

In a first embodiment of the present invention, a compression device located within a compression chamber of an electric compressor is provided. The electric compressor is configured to compress a refrigerant and includes a housing, a refrigerant inlet port, a refrigerant outlet port, a motor, and a drive shaft. The housing defines an intake volume and a discharge volume and has a center axis. The housing defines the compression chamber. The refrigerant inlet port is coupled to the housing and is configured to introduce the refrigerant to the intake volume. The refrigerant outlet port is coupled to the housing and is configured to allow compressed refrigerant to exit the electric compressor from the discharge volume. The motor is mounted inside the housing. The drive shaft is coupled to the motor and is configured to rotate about the center axis. The compression device is coupled to the drive shaft and is configured to receive the refrigerant from the intake volume and to compress the refrigerant as the drive shaft is rotated by the motor. The compression device includes a piston device including a cylinder and a rolling piston. The cylinder is eccentrically coupled to the drive shaft. The cylinder has a circular outer circumference. The rolling piston is tubular and concentric with the cylinder. The rolling piston has an outer surface in contact with an inner surface of the compression chamber. The rolling piston rotates the cylinder as the drive shaft and the piston device is rotated by the motor. A vane moveably coupled to the housing and having an end adjacent the compression chamber is biased such that the end of the vane is in contact with the rolling piston as the piston device is rotated by the drive shaft. The housing, piston device, and the vane forming variable sub-chambers within the compression chamber as the piston device is rotated within the compression chamber, wherein refrigerant enters one of the sub-chambers from the intake volume, is compressed as the piston device is rotated, and exits the one of the sub-chambers into the discharge volume.

In a second embodiment of the present invention, an electric compressor configured to compress a refrigerant is provided. The electric compressor includes a housing, a refrigerant inlet port, a refrigerant outlet and a compression device. The housing defines an intake volume and a discharge volume and has a center axis. The housing further defines a compression chamber. The refrigerant inlet port is coupled to the housing and is configured to introduce the refrigerant to the intake volume. The refrigerant outlet port is coupled to the housing and is configured to allow compressed refrigerant to exit the electric compressor from the discharge volume. The compression device is located within the compression chamber and is coupled to a drive shaft. The compression device is configured to receive the refrigerant from the intake volume and compress the refrigerant as the drive shaft is rotated. The compression device includes a piston device including a cylinder and a rolling piston and a vane. The cylinder is eccentrically coupled to the drive shaft. The cylinder has a circular outer circumference. The rolling piston is tubular and concentric with the cylinder. The rolling piston has an outer surface in contact with an inner surface of the compression chamber. The rolling piston rotates about the cylinder as the drive shaft and the piston device is rotated by the motor. The vane is moveably coupled to the housing and has an end adjacent the compression chamber. The vane is biased such that the end of the vane is in contact with the rolling piston as the piston device is rotated by the drive shaft. The housing, piston device, and the vane form variable sub-chambers within the compression chamber as the piston device is rotated within the compression chamber. Refrigerant enters one of the sub-variable sub-chambers from the intake volume, is compressed as the piston device is rotated, and exits the one of the sub-chambers into the discharge volume.

In a third embodiment of the present invention, an electric compressor configured to compress a refrigerant is provided. The electric compressor includes a housing, motor, a drive shaft, a refrigerant inlet port, a refrigerant outlet and a compression device. The motor is mounted within the housing. The drive shaft is coupled to the motor and configured to rotate about the center axis. The housing defines an intake volume and a discharge volume and has a center axis. The housing further defines a compression chamber. The refrigerant inlet port is coupled to the housing and is configured to introduce the refrigerant to the intake volume. The refrigerant outlet port is coupled to the housing and is configured to allow compressed refrigerant to exit the electric compressor from the discharge volume. The compression device is located within the compression chamber and is coupled to the drive shaft. The compression device is configured to receive the refrigerant from the intake volume and compress the refrigerant as the drive shaft is rotated by the motor. The compression device includes a piston device including a cylinder and a rolling piston and a vane. The cylinder is eccentrically coupled to the drive shaft. The cylinder has a circular outer circumference. The rolling piston is tubular and concentric with the cylinder. The rolling piston has an outer surface in contact with an inner surface of the compression chamber. The rolling piston rotates about the cylinder as the drive shaft and the piston device is rotated by the motor. The vane is moveably coupled to the housing and has an end adjacent the compression chamber. The vane is biased such that the end of the vane is in contact with the rolling piston as the piston device is rotated by the drive shaft. The housing, piston device, and the vane form variable sub-chambers within the compression chamber as the piston device is rotated within the compression chamber. Refrigerant enters one of the sub-variable sub-chambers from the intake volume, is compressed as the piston device is rotated, and exits the one of the sub-chambers into the discharge volume.

In a fourth embodiment of the present invention, an electric compressor configured to compress a refrigerant is provided. The electric compressor includes a housing a refrigerant inlet port, a refrigerant outlet port, a motor, an inverter module, a drive shaft and a compression device. The housing defines an intake volume and a discharge volume and has a center axis. The housing includes a central housing, a cylinder housing, a rear head, and an inverter cover. The central housing and the inverter cover form an inverter cavity. The cylinder housing forms a compression chamber and has a vane slot connected to the discharge volume. The refrigerant inlet port is coupled to the housing and is configured to introduce the refrigerant to the intake volume. The refrigerant outlet port is coupled to the housing and is configured to allow compressed refrigerant to exit the electric compressor from the discharge volume. The discharge volume is formed, at least partially, by the central housing, the rear head, and the refrigerant outlet port. The motor is mounted inside the housing. The inverter module is mounted inside the inverter cavity and configured to convert direct current electrical power to alternating current electrical power. The drive shaft coupled to the motor and is configured to rotate about the center axis. The compression device is located within the compression chamber and is coupled to the drive shaft. The compression device is configured to receive the refrigerant from the intake volume and compress the refrigerant as the drive shaft is rotated by the motor. The compression device includes a piston device and a vane. The piston device includes a cylinder and a rolling piston. The cylinder is eccentrically coupled to the drive shaft. The cylinder has an interior chamber and a rotational center of mass about the center axis. The cylinder has a circular outer circumference. The rolling piston is tubular and concentric with the cylinder. The rolling piston has an outer surface in contact with an inner surface of the compression chamber. The rolling piston rotates about the cylinder as the drive shaft and the piston device is rotated by the motor. The vane is located within the vane slot and has an end adjacent the compression chamber. The vane is biased towards the piston device by refrigerant within the discharge volume such that the end of the vane is in contact with the rolling piston as the piston device is rotated by the drive shaft. The housing, piston device, and the vane form variable sub-chambers within the compression chamber as the piston device is rotated within the compression chamber. The refrigerant enters one of the sub-variable sub-chambers from the intake volume, is compressed as the piston device is rotated, and exits the one of the sub-chambers into the discharge volume.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

Figure 1A:
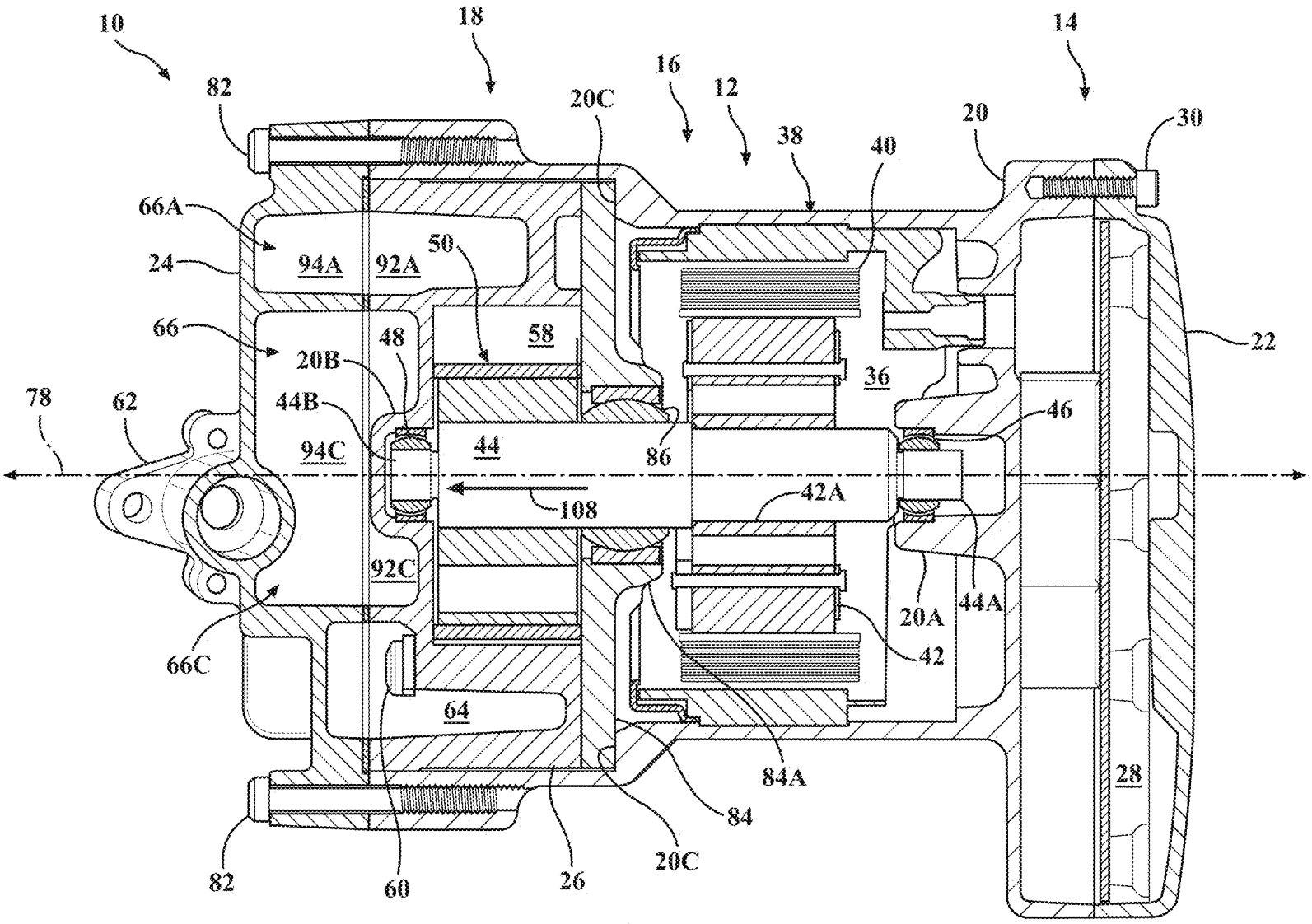
FIG. 1A is a cross-sectional view of a compressor according to an embodiment of the present invention.

With reference to the FIGS, wherein like numerals indicate like or corresponding parts throughout the several views, a compressor 10 having a housing 12 is provided. The electric compressor 10 is particularly suitable in a motor vehicle, such as an automotive vehicle (not shown). The electric compressor 10 may be used as a cooling device or as a heating pump to heat and/or cool different aspects of the vehicle. For instance, the electric compressor 10 may be used as part of the heating, ventilation and air conditioning (HVAC) system in electric vehicles (not shown) to cool or heat a passenger compartment.

In addition, the electric compressor 10 may be used to heat or cool the passenger compartment, on-board electronics and/or a battery used for powering the vehicle while the vehicle is not being operated, for instance, during a charging cycle. The compressor 10 may further be used while the vehicle is not being operated and while the battery is not being charged to maintain, or minimize the degradation, of the life of the battery.

In the illustrated embodiment, the electric compressor 10 is a rotary-type compressor that acts to compress a refrigerant rapidly and efficiently for use in different systems of a motor vehicle, for example, an electric or a hybrid vehicle. In use, a mixture of refrigerant and oil (for lubrication) may be used. In one aspect of the present invention, the oil may be separated from the refrigerant prior to the refrigerant exiting the compressor 10.

The electric compressor 10 includes a housing 12 and a compression device 18 located, or contained, within the housing 12. The compressor 10 has center axis 78. As explained in more detail below, the compression device 18.

In the illustrated embodiment, the electric compressor 10 may include an inverter section 14 and a motor section 16. The housing 12 may include a central housing 20, an inverter back cover 22, a rear head 24 (which may be referred to as the discharge head), and a cylinder housing 26. As shown, the central housing 20 may house the motor section 16 and the compression device 18. In other embodiments, the inverter section 14 and/or the motor section 16 may be external to the housing 12.

In one embodiment, the inverter back cover 22, the central housing 20, the cylinder housing 26, and the rear head 24 may be composed from machined aluminum. The compressor 10 may be mounted, for example, within the body of a motor vehicle, via a plurality of mount points (not shown).

General Arrangement, and Operation, of the Electric Compressor 10

The inverter back cover 22 and one end of the central housing 20 form an inverter cavity 28. The inverter back cover 22 is mounted to the central housing 20 by a plurality of bolts 30 (only one of which is shown in FIG. 1A). An inverter gasket (not shown) may be positioned between the inverter back cover 22 and the central housing 20 keeps moisture, dust, and other contaminants from the inverter cavity 28. The rear head 24 may be mounted to the central housing 20 be a plurality of bolts 82.

An inverter module 32 mounted within the inverter cavity 28 formed by the inverter back cover 22 and the central housing 20. The inverter module 32 may include an inverter circuit 34 mounted on a printed circuit board, which is mounted to the central housing 20. The inverter circuit 34 converts direct current (DC) electrical power received from outside of the electric compressor 10 into three-phase alternating current (AC) power to supply/power a motor 38 (see below). The inverter circuit may also control the rotational speed of the electric compressor 10. High voltage DC current is supplied to the inverter circuit via a high voltage connector (not shown). Low voltage DC current to drive the inverter circuit, as well as control signals to control operation of the inverter circuit, and the motor section 16, may be supplied via a low voltage connector (not shown).

The central housing 20 forms a motor cavity 36. The motor section 16 includes a motor 38 located within the motor cavity 36. In one embodiment, the motor 38 is a three-phase AC motor having a stator 40 and a rotor 42. The stator 40 has a generally hollow cylindrical shape with six individual coils (two for each phase). The stator 42 is contained within, and mounted to, the central housing 20 and remains stationary relative to the central housing 20. The rotor 42 is located within, and centered relative to, the stator 40.

A drive shaft 44 is coupled to the rotor 42 and rotates therewith. In the illustrated embodiment, the draft shaft 44 is press-fit within a center aperture 42A of the rotor 42. The drive shaft 44 has a first end 44A and a second end 44B. As shown, the central housing 20 includes a first drive shaft supporting member 20A within the motor cavity 36. A first ball bearing 46 located within an aperture formed by the first drive shaft supporting member 20A supports and allows the first end 44A of the drive shaft 44 to rotate. In the illustrated embodiment, the cylinder housing 26 includes a second drive shaft supporting member 20B. A second ball bearing 48 located within an aperture formed by the second drive shaft supporting member 20B allows the second end 44B of the drive shaft 44 to rotate. In the illustrated embodiment, the first and second ball bearing 46, 48 are press-fit with the apertures formed by the first drive shaft supporting member 20A and the second drive shaft supporting member 20B, respectively.

As stated above, the electric compressor 10 is a rotary-type compressor. In one aspect of the present invention, the compression device 18 includes a piston device 50 eccentrically coupled to the second end 44B of the drive shaft 44 and a vane 56. As will be explained in more detail below, as the drive shaft 44 is rotated within a compression chamber 58 by the cylinder housing 26 of the housing 12. Further, the vane 56 is biased inward.

Generally, intermixed refrigerant and oil (at low pressure) enters the electric compressor 10 via a refrigerant inlet port 60 and exits the electric compressor 10 (at high pressure) via refrigerant outlet port 62 after being compressed by the compression device 18. Refrigerant follows a refrigerant path through the electric compressor 10. Refrigerant enters the refrigerant inlet port 60 and enters an intake volume 64 formed between the cylinder housing 26 and the rear head 24 (see FIGS. 1A-1B) adjacent the refrigerant inlet port 60. Refrigerant is then drawn through the motor section 16 and enters the compression chamber 58 (see below).

The refrigerant is compressed by the compression device 18 and exits the compression chamber 58 into the discharge volume 66. The discharge volume 66 is in communication with the refrigerant output port 62. Pressurized refrigerant leaves the compression device 18 through one or more orifices 90 (see FIGS. 7B-7C). The release of pressurized refrigerant may be controlled by a reed mechanism 72.

Compression Device with Balanced Rolling Piston

With particular reference to FIGS. 1A-1B, 2A-2B, 3A-3G, 4 and 5A-5B, a compression device 18, according to an embodiment of the present invention includes the cylinder housing 26 and a piston device 50 which includes a cylinder 52 and a rolling piston 54. The compression device 18 is located within the compression chamber 58 and is coupled to the drive shaft 44. Generally, the compression device 18 is configured to receive the refrigerant from the intake volume 64 and to compress the refrigerant as the drive shaft 44 is rotated by the motor 38.

The cylinder 52 has a circular cross section and outer circumference and is eccentrically coupled to the drive shaft 44. The rolling piston 54 is tubular and concentric with the cylinder 52. The rolling piston 54 has an outer surface 54A in contact with an inner surface 58A of the compression chamber 58. The rolling piston 54 rotates about the cylinder 52 as the drive shaft 44 and the piston device 50 is rotated by the motor 38.

In the illustrated embodiment, the compression device 18 further includes a vane 56. The vane 56 is moveably coupled to the housing 12. As shown, one end 56A of the vane 56 is adjacent the compression chamber 58 and the vane is biased such that the end 56A of the vane 56 is in contact with the rolling piston 54 as the piston device 50 is rotated by the drive shaft 44. The vane 56 may be biased inward via a spring (not shown) or other suitable mechanism. The housing 12, piston device 50, and the vane 56 form variable sub-chambers 58B, 58C within the compression chamber 58 as the piston device 50 is rotated within the compression chamber 58. As explained in further detail below, refrigerant enters one of the sub-variable sub-chambers from the intake volume 64, is compressed as the piston device 50 is rotated, and exits the one of the sub-chambers 58B, 58C into the discharge volume 66.

Figure 3A:
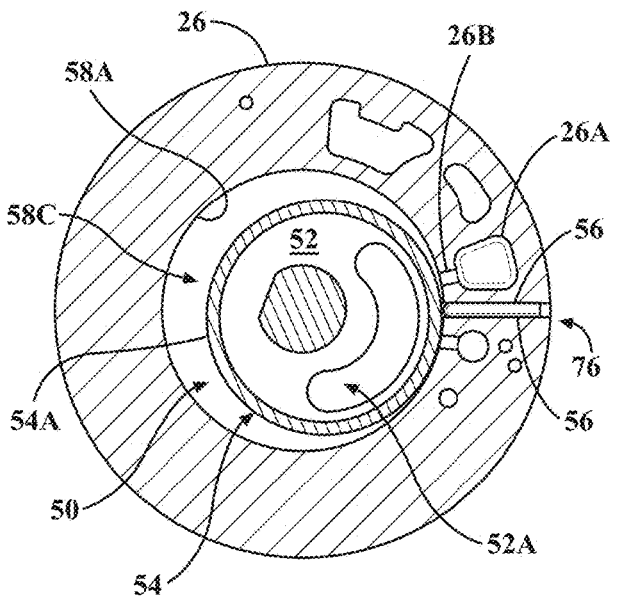
FIGS. 3A-3G are cross-sectional views of the compression device of FIG. 2A during a compression cycle.

With reference to FIGS. 3A-3G, the position or status of the compression device 18 during a compression cycle of the compressor 10 is shown. At the start of a compression cycle (as shown in FIG. 3A), the vane 56 is pressed outward by the outer surface 54A of the rolling piston 54 such that the end 56A of the vane 56 is flush with the inner surface 58A of the compression chamber 58. At this point in the compression cycle, the compression chamber 58 has a single sub-chamber 58C.

Figure 3B:
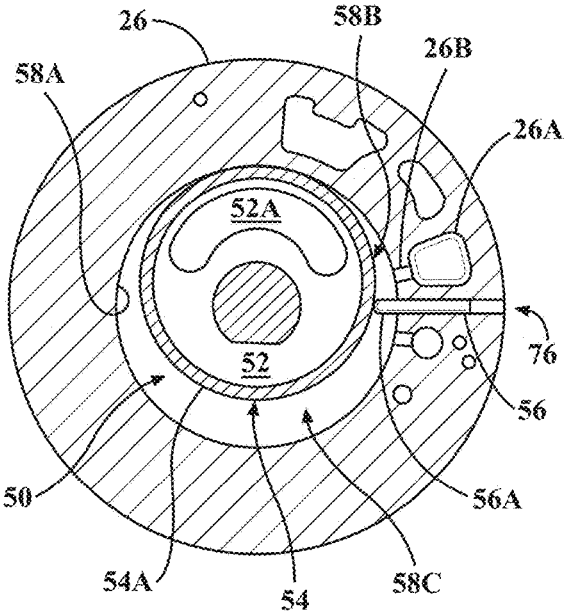

As the piston device 50 is rotated, sub-chamber 58B is formed by outer surface 54A of the rolling piston 54, the vane 56, and the inner surface 58A of the compression chamber 58 (see FIG. 3B). As shown in FIGS. 3A-3F, the cylinder housing 26 of the housing 12 includes an internal suction chamber 26A connected to the intake volume 64 and to the compression chamber 58 via a suction port 26B.

Figure 3C:
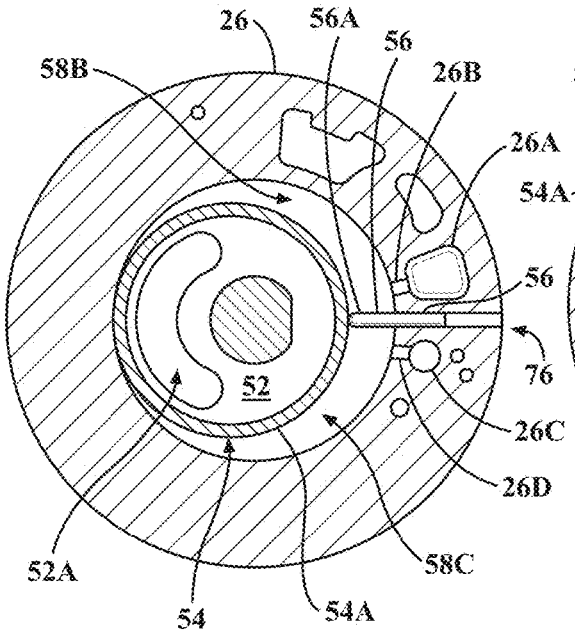
Figure 3D:
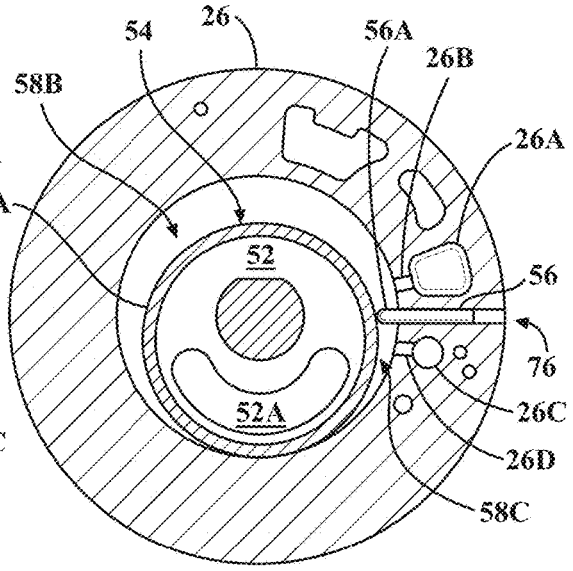
Figure 3E:
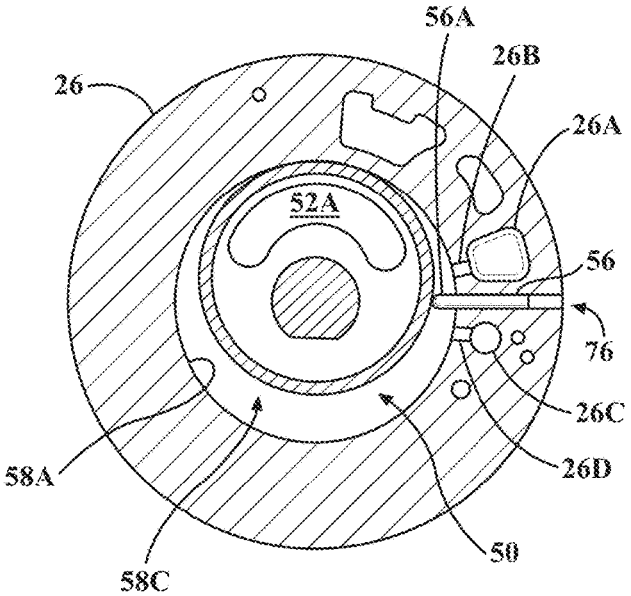

Returning to FIG. 3B, the sub-chamber 58B is open to the suction chamber 26A and refrigerant enters the sub-chamber 58B. As shown in FIGS. 3C-3D, as the piston device 50 is rotated by the drive shaft 44, the volume of sub-chamber 58B increases and refrigerant continues to enter or file the sub-chamber 58B.

Figure 3F:
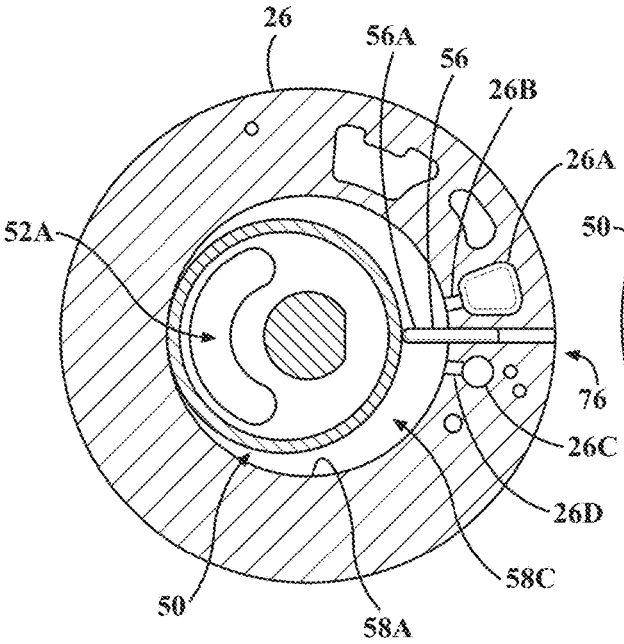

As shown in FIG. 3F, as the piston device 50 continues to be rotated, the sub-chamber 58B is cut-off from the internal suction chamber 26A and suction port 26B, and thus, the intake volume 64. As shown in FIGS. 3A-3G, in the illustrated embodiment the cylinder housing 26 includes an internal discharge chamber 26C which is connected to the discharge volume 66 and to the compression chamber 58 via a discharge port 26D.

Figure 3G:
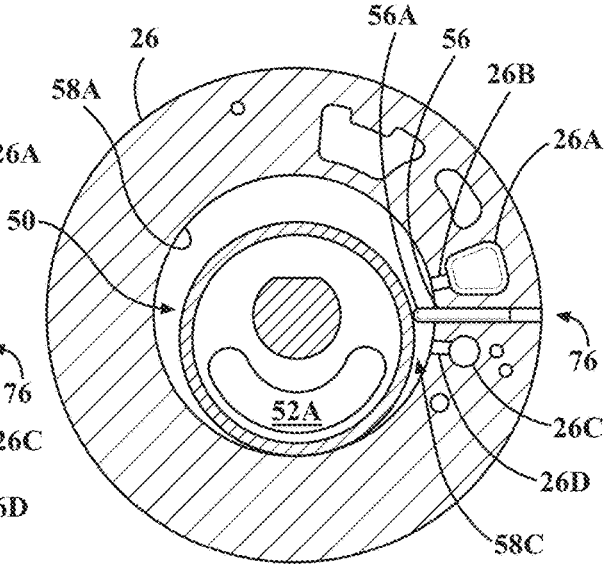

As shown in FIG. 3F, when the sub-chamber 58B is isolated or cut-off from the intake volume 64, the sub-chamber is connected to the internal discharge chamber 26C and discharge port 26D (see FIGS. 3F-3G).

As the piston device 50 continues to be rotated, the sub-chamber 58B decreases, thereby compressing the refrigerant. The release of pressurized refrigerant is controlled by a reed mechanism 72 coupled to a rear side of the cylinder housing 26 (see FIG. 6C). In the illustrated embodiment, a single reed mechanism 72 is used. However, it should be noted that more than one reed mechanism may be used. In one embodiment, the reed mechanism 72 may include a discharge reed (not shown) and a reed retainer 72A. The discharge reed may be made from a flexible material, such as steel. The characteristics, such as material and strength, are selected to control the pressure at which the pressurized refrigerant is released from the compression device 18. The reed retainer 72A is made from a rigid, inflexible material, such as stamped steel. The reed retainer 72A controls or limits the maximum displacement of the discharge reed relative to the cylinder housing 26. In the illustrated embodiment, the read mechanism 72 is held or fixed to the cylinder housing 26 via a fastener 74.

As shown FIGS. 2A-2B and 3A-3G, in the illustrated embodiment, the cylinder housing 26 includes a vane slot 76 configured to slidably receive the vane 56. The vane slot 76 has a first end 76A open to or adjacent the compression chamber 58 and a second end 76B located at adjacent an outer surface of the cylinder housing 26 (see FIG. 2B). In the illustrated embodiment the second end 76B of the vane slot 76 is coupled to the discharge volume 66. During operation, pressured refrigerant from the discharge volume 66 applied a force on the vane 56 biasing the vane 56 such that the end of the vane 56A remains in contact with the outer surface of the rolling piston 54A.

Figure 1B:
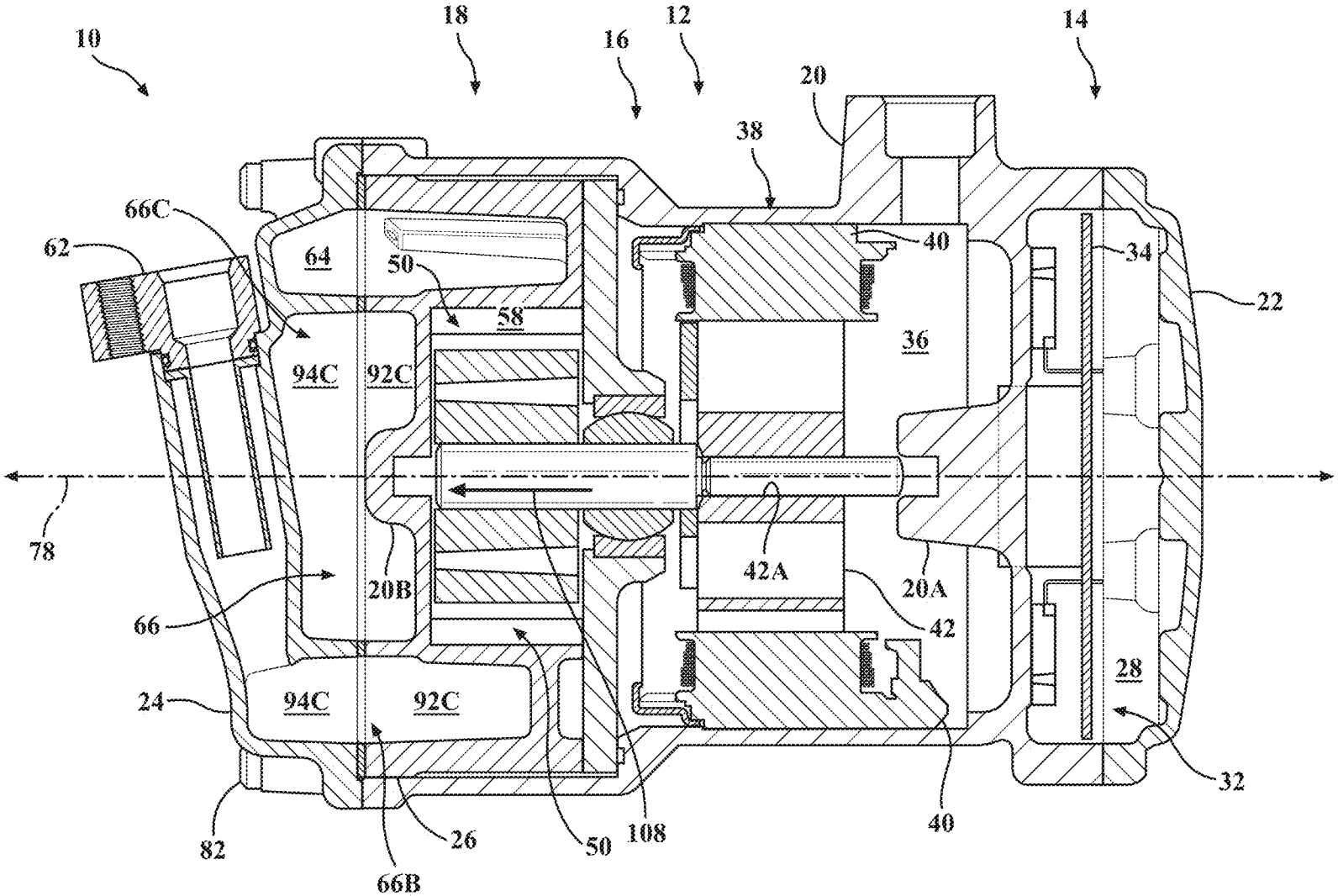
FIG. 1B a second cross-sectional view of the electric compressor of FIG. 1A.
Figure 4:
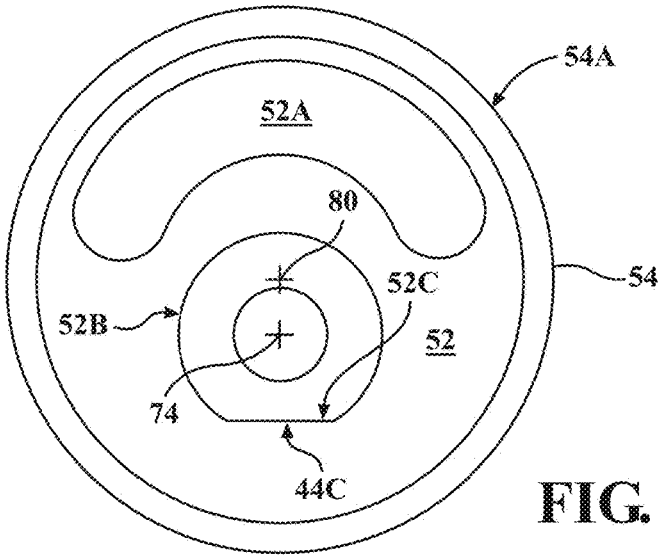
FIG. 4 is a graphical representation of a piston device of the compression device of FIG. 2A, according to an embodiment of the present invention.

The cylinder 52 and the rolling piston 54 may be composed from cast-iron. As shown in FIGS. 1A, 1B and FIG. 4, in the illustrated embodiment, drive shaft 44 is centered on the center axis 78 of the compressor 10. The piston device 50 has a piston center axis 80 that is offset from the center axis 78 (see FIGS. 2B and 4).

In one aspect of the present invention, the cylinder 52 has an interior chamber 52A that is hollow. The cylinder 52 and the interior chamber 52A is configured such that the rotational center of mass is aligned with the center axis 78 of the compressor 10 and drive shaft 44. This arrangement eliminates the need for other separate balancing components or mechanisms. As shown, in the illustrated embodiment the interior chamber 52A is located on the compression side of the cylinder housing 26.

Figure 2A:
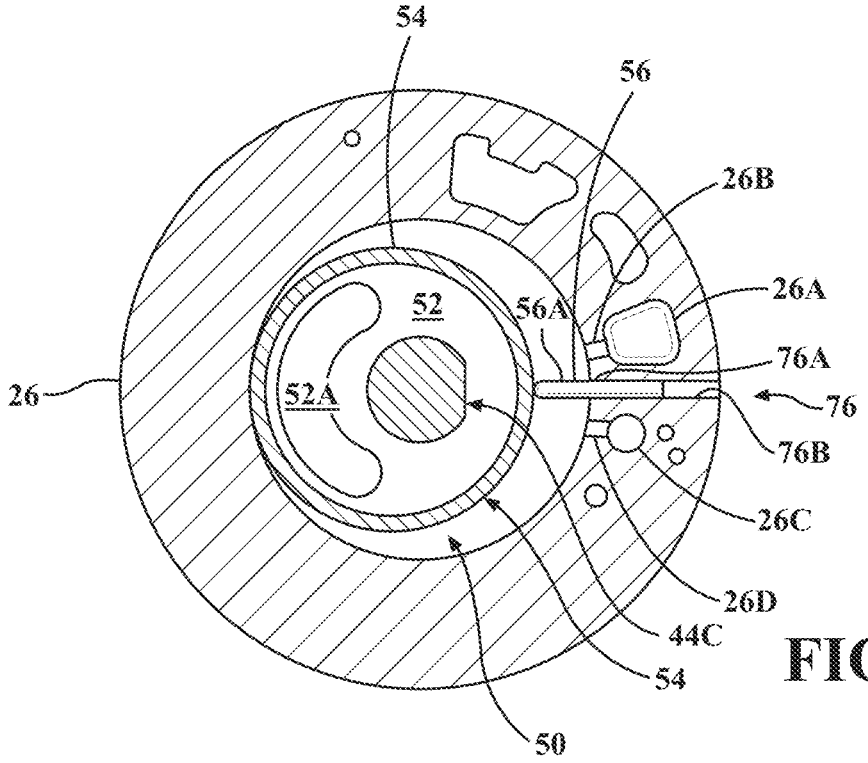
FIG. 2A is a cross-sectional view of a compression device of the electric compression of FIG. 1A, according to an embodiment of the present invention.
Figure 2B:
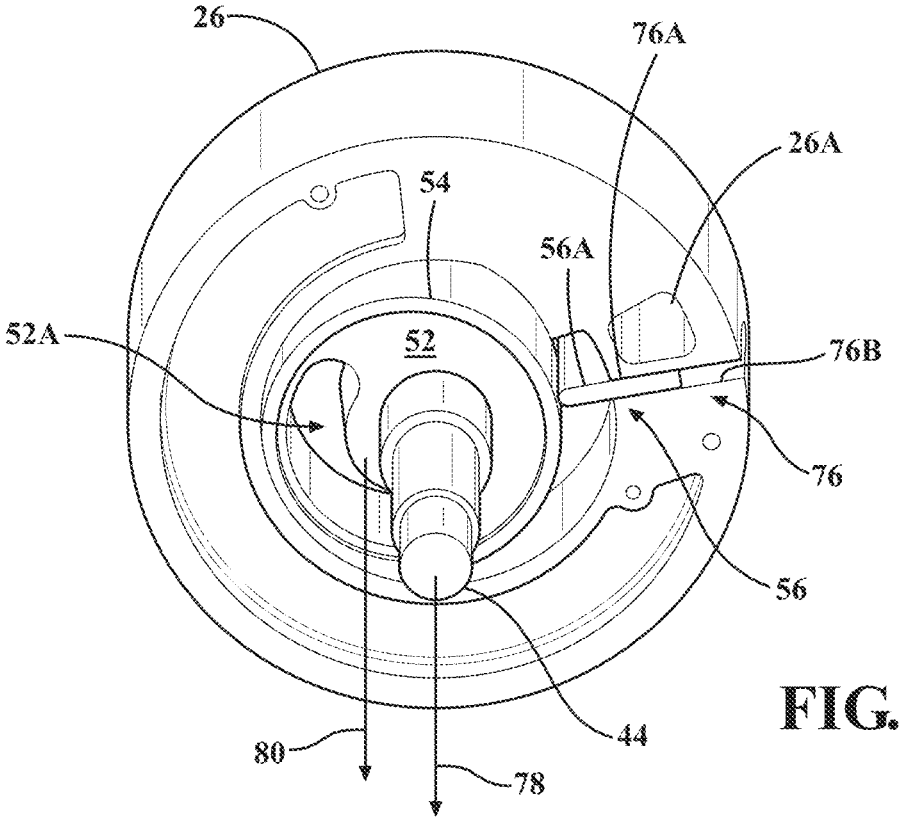
FIG. 2B is a perspective view of the compression device of FIG. 2A.
Figure 5A:
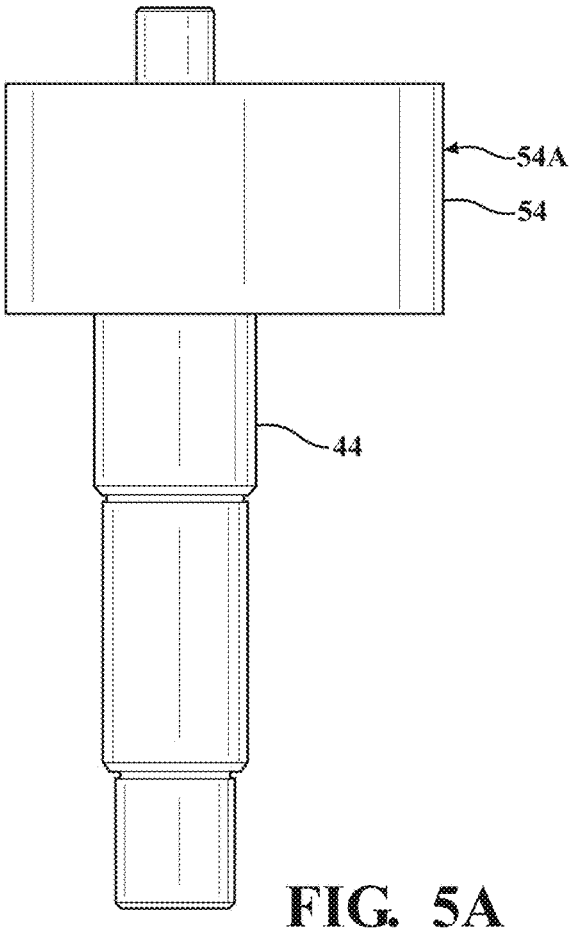
FIG. 5A is a side view of a drive shaft of the electric compressor and the piston device of FIG. 4, according to an embodiment of the present invention.
Figure 5B:
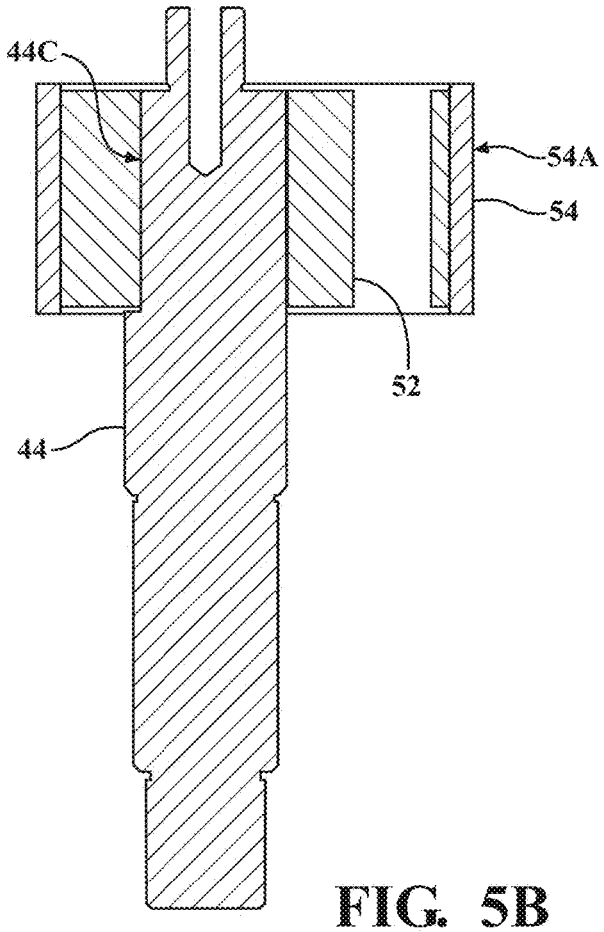
FIG. 5B is a cross-sectional view of the drive shaft and piston device of FIG. 5A.

In one embodiment of the present invention, the piston device 50 and the cylinder 52 is keyed to the drive shaft 44. As shown in FIG. 2A, 4, 5B, in the illustrated embodiment, the embodiment, of the present invention, one end of the drive shaft 44 has a flat surface 44C. The cylinder 52 has an aperture 52B with a flat side 52C configured to receive the end of the drive shaft 44. In one aspect of the present invention, the cylinder 52 and the drive shaft 44 have an interference fit therebetween.

Figure 6A:
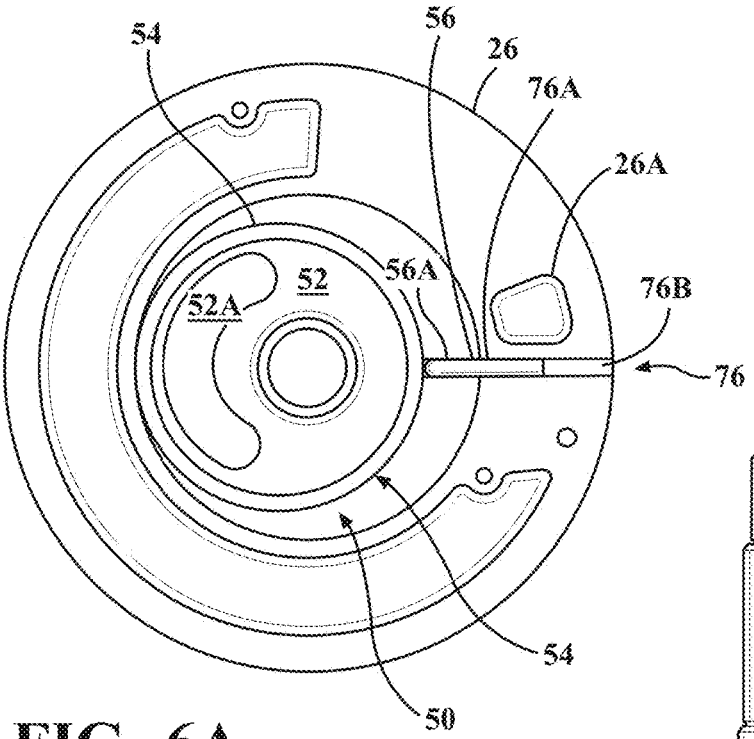
FIG. 6A is a front view of a compression device having integrated discharge chambers, according to an embodiment of the present invention.
Figure 6B:
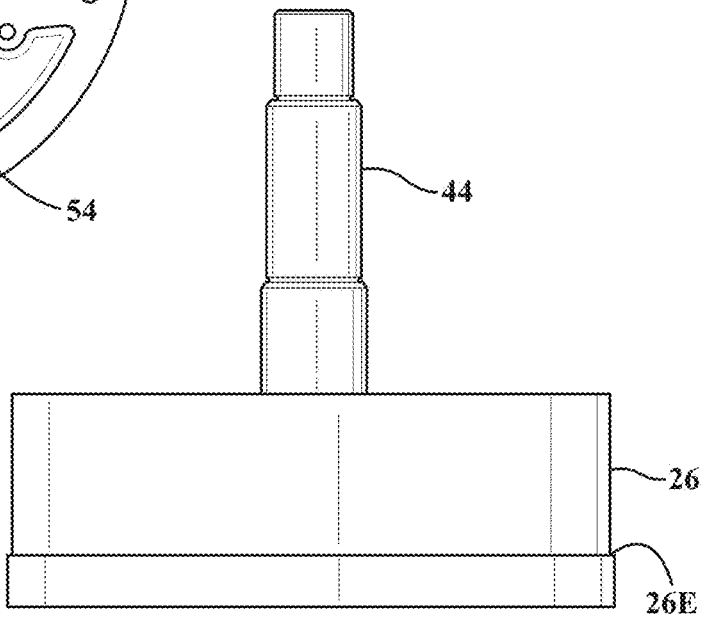
FIG. 6B is a side view of the compression device of FIG. 6A and a drive shaft, according to an embodiment of the present invention.
Figure 6C:
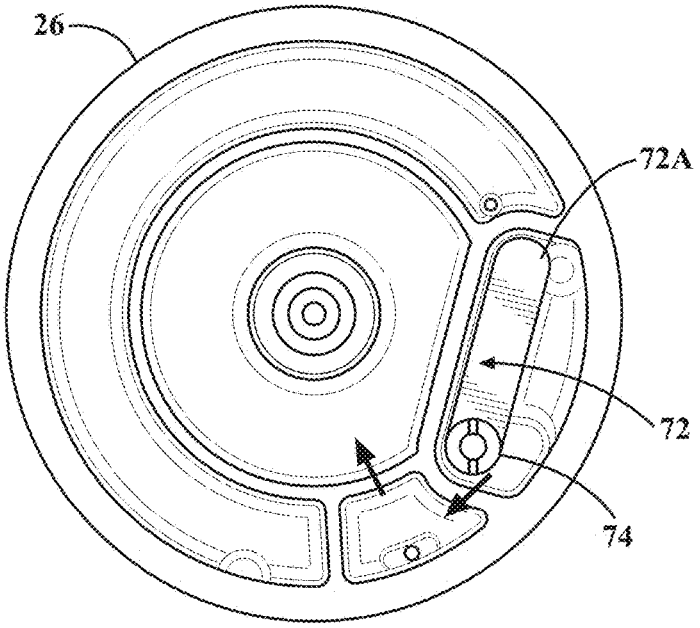
FIG. 6C is a rear view of the compression device of FIG. 6A.

As shown in FIG. 6C, the cylinder housing 26 may include a lip 26E to assist in properly positioning the rolling piston 54 relative to the cylinder housing 26. The inner diameter of the rolling piston 54 may be slightly larger than the outer diameter of the cylinder 52 to enable refrigerant therebetween for lubrication purposes.

Returning to FIG. 1A, in the illustrated embodiment, the compression device 18 may further include an inner cover 84. The inner cover 84 is configured to be positioned within central housing 20 adjacent a flange 20C of the central housing 20. As shown, when the compressor 10 is assembled, the compression chamber 58 is formed by the inner cover 84 and the cylinder housing 26. the piston device 50 is located within the compression chamber 58. As shown, the inner cover 84 forms a third drive shaft supporting member 84A configured to receive a third ball bearing 86. The drive shaft 44 positioned through, and supported by, the third ball bearing 86 and the third drive draft supporting member 84A. As shown, the rear head 24 is fastened to the center housing 20 by the bolts 82.

Compression Device Sub-Assembly with Integrated Discharge Chambers

With particular reference to FIGS. 1A-1B, 7A-7C and 8, in one aspect of the present invention, the electric compressor 10 may include a compression device sub-assembly 88 with one or more integrated discharge chambers or high-side pressure cavities 66A, 66B, 66C (see FIGS. 1A-1B). In the illustrated embodiment, the compression device sub-assembly 88 includes the cylinder housing 26 and the compression device 18.

As discussed above, the electric compressor 10 is configured to compress a refrigerant and including the housing 12, a refrigerant inlet port 60, the refrigerant outlet port 62, the motor 38, and the drive shaft 44. The housing 12 defines the intake volume 64 and has a center axis 78. The refrigerant inlet port 60 is coupled to the housing 12 is and configured to introduce the refrigerant to the intake volume 64. The refrigerant outlet port 62 is coupled to the housing 12 and is configured to allow compressed refrigerant to exit the electric compressor 10. The motor 38 is mounted inside the housing 12. The drive shaft 44 is coupled to the motor 38 and is configured to rotate about the center axis 78.

In the illustrated embodiment, the compression device sub-assembly includes the cylinder housing 26 (which may also be part of the housing 12) and the piston device 50. The cylinder housing 26 and the piston device 50 may be referred to as the compression device 18.

Figure 7A:
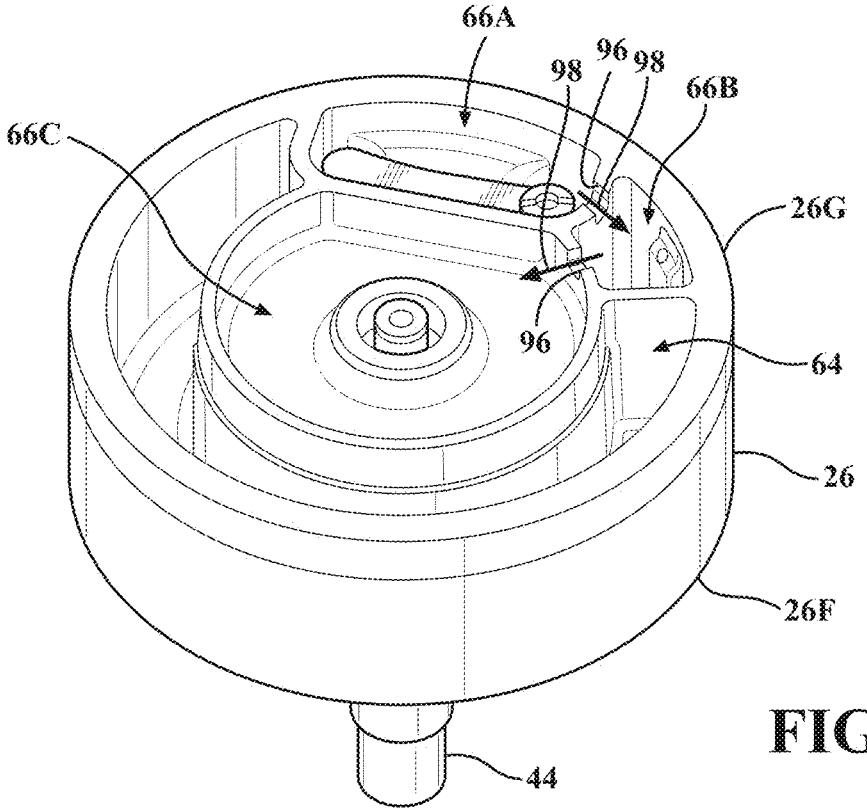
FIG. 7A is a perspective view of the compression device of FIG. 6A.
Figure 7B:
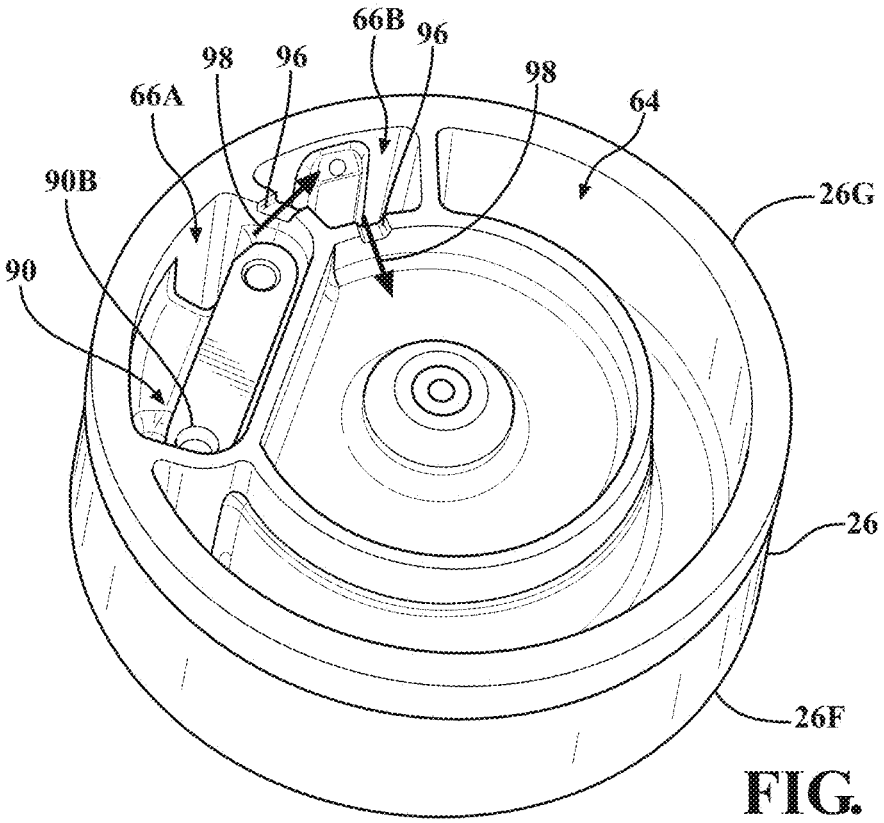
FIG. 7B is a first perspective view of a cylinder housing of the compression device of FIG. 6A, according to an embodiment of the present invention.
Figure 7C:
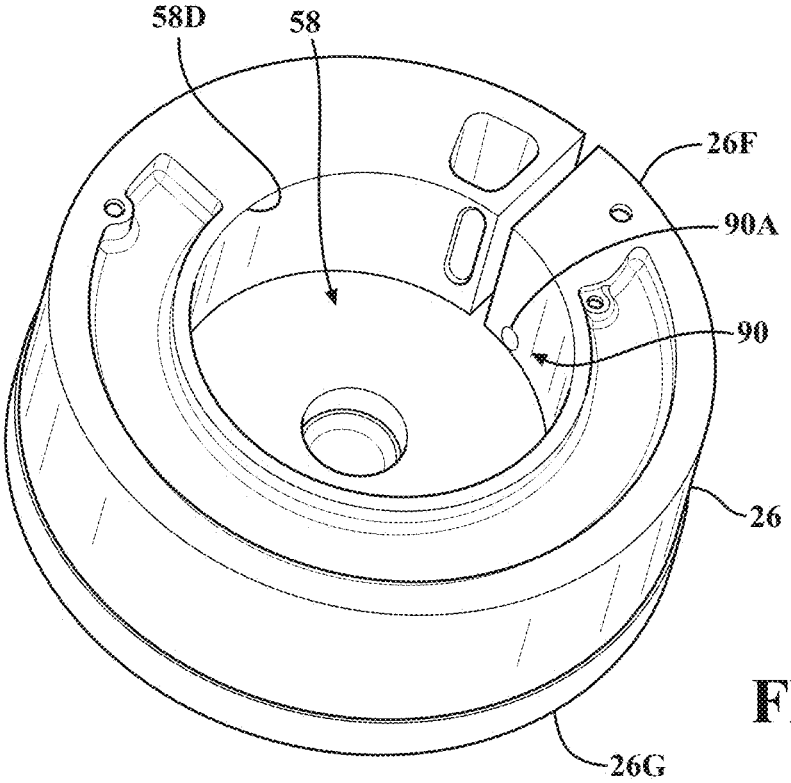
FIG. 7C is a second perspective view of the cylinder housing of FIG. 7B.
Figure 8:
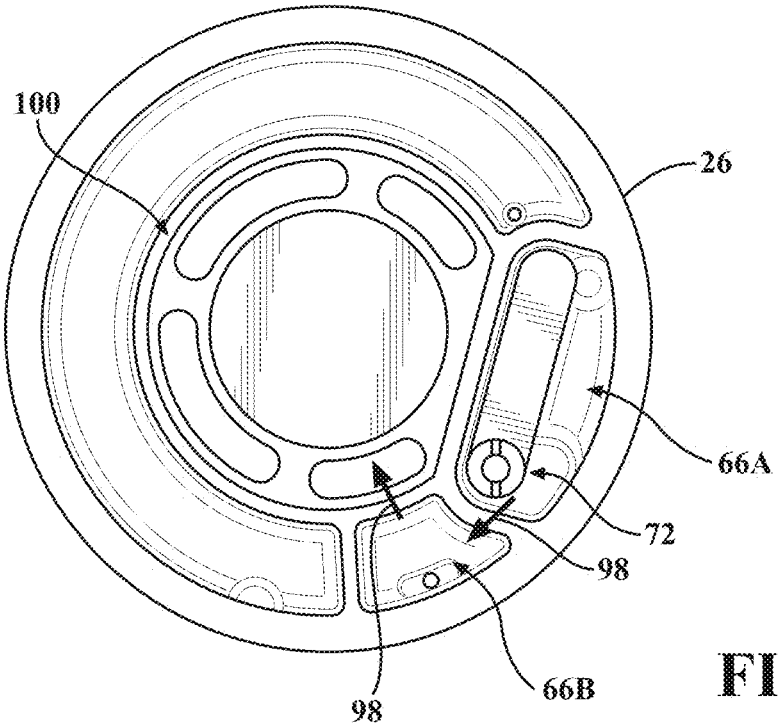
FIG. 8 is a rear view of a compression device and a magnetic debris filter, according to an embodiment of the present invention.

With particular reference to FIG. 7A, the cylinder housing 26 has a first side 26F and a second side 26G. The cylinder housing 26 forms, at least in part, the compression chamber 58. The compression chamber 58 having an open end 58D adjacent the first side 26F of the cylinder housing 26. One or more high-side pressure cavities 66A, 66B, 66C formed at least partly within the second side 26G of the cylinder housing 26. The one or more high-side pressure cavities 66A, 66B, 66C forming at least part of a discharge chamber 66. Compressed refrigerant exits the compression chamber 18 into the discharge chamber 66 (or the one or more high-side pressure cavities 66A, 66B, 66C via the orifice 90. As shown in FIGS. 7B-7C, in the illustrated embodiment, the orifice 90 has a first end 90A located within the compression chamber 18 and and a second end 90B located within one of the high-side pressure cavities 66A, 66B, 66C. The second end 90B of the orifice 90 is located adjacent the reed mechanism 72. In operation, compressed refrigerant is released from the compression chamber 18 during a compression cycle when the pressure of the refrigerant is above a predetermined threshold. The predetermined threshold is determined by the reed mechanism 72.

The compression device sub-assembly 88 includes the compression device 18. In the illustrated embodiment, the piston device 50 may include the cylinder 52 and the rolling piston 54. As discussed above, the cylinder 52 is eccentrically coupled to the drive shaft 44 and has a circular outer circumference. The rolling piston 54 may be tubular and concentric with the cylinder 52. The rolling piston 54 has an outer surface 54A in contact with the inner surface 58A of the compression chamber 58. In operation, the rolling piston 54 rotates about the cylinder 52 as the drive shaft 44 and the piston device 50 is rotated by the motor 38.

By integrating, at least in part, the high-side pressure cavities 66A, 66B, 66C and/or the discharge cavity 66 within the cylinder housing 26 the overall package size of the compressor 10 may be reduced.

In one aspect of the present invention, the rear head 24 may form the end of each high-side pressure cavities 66A, 66B, 66C. In embodiment, an inner side of the rear head 24 may be substantially (or relatively) flat. In other words, the discharge cavity 66 is composed or located mostly within the cylinder housing 26 and the rear head 24 represents one side of each high-side pressure cavities 66A, 66B, 66C.

In another embodiment, the one or more high-side pressure cavities 66A, 66B, 66C may be formed by the cylinder housing 26 and the rear head 24. With particular reference to FIGS. 1A-1B, the cylinder housing 26 may include one or more cylinder housing recesses 92A, 92B, 92C and the rear head 24 may includes one or more rear head recesses 94A, 94B, 94C. Each of the high-side pressure cavities 66A, 66B, 66C may be composed of one of the cylinder housing recesses 92A, 92B, 92C and one of the rear head recesses 94A, 94B, 94C.

As discussed above, in the illustrated embodiment, the compression device 18 may further include a vane 56 moveably coupled to the cylinder housing 26. The vane 56 has an end 56A adjacent the compression chamber 58. The vane 56 is biased such that the end 56A of the vane 56 is in contact with the rolling piston 54 as the piston device 50 is rotated by the drive shaft 44. In the illustrated embodiment, the vane 56 is located within a vane slot 76 of the cylinder housing 26.

The housing 12 or cylinder housing 26, the piston device 50, and the vane 56 form variable sub-chambers 58B, 58C within the compression chamber 58 as the piston device 50 is rotated within the compression chamber 58. As discussed above, refrigerant enters one of the sub-variable sub-chambers 58B, 58C from the intake volume 64, is compressed as the piston device 50 is rotated, and exits the one of the sub-chambers 58B, 58C into the discharge volume 66.

With particular reference to FIGS. 7A and 7B, the cylinder housing 26 may further include a slot 96 between the high-side pressure cavities 66A, 66B, 66B allow pressure refrigerant to flow therebetween (as shown by arrows 98).

Magnetic Debris Filter

With particular reference to FIGS. 8, 9A-9B, and 10A-10C, in another aspect of the present invention, the electric compressor 10 may include a magnetic debris filter 100. The magnetic debris filter 100 is configured to capture debris created during the compression cycle of the electric compressor 10. Generally as discussed above, the electric compressor 10 is configured to compress a refrigerant and includes a housing 12, a refrigerant inlet port 60, a refrigerant outlet port 62, and a compression device 18. The housing 12 defines an intake volume 64 and a discharge volume 66 and has a center axis 78. The housing 12 further defines a compression chamber 58. The refrigerant inlet port 60 is coupled to the housing 12 and is configured to introduce the refrigerant to the intake volume 64. The refrigerant outlet port 62 is coupled to the housing 12 and is configured to allow compressed refrigerant to exit the electric compressor 12 from the discharge volume 66. The compression device 18 is located within the compression chamber 58 and is coupled to a drive shaft 44. The compression device 18 is configured to receive the refrigerant from the intake volume 64 and compress the refrigerant as the drive shaft 44 is rotated. The housing 12, the compression device 18, and the compression chamber 58 define a refrigerant flow path 108 (shown in part in FIGS. 1A and 1B) between the refrigerant inlet port 60 and the refrigerant outlet port 62. As discussed in more detail below, the housing 12 defines a filter mounting aperture 102 located after the compression device 18 in the refrigerant flow path 108.

In the illustrated embodiment, the housing 12 may include a cylinder housing 26. In one embodiment, the filter mounting aperture 102 is located within the cylinder housing 26. For example, in the embodiment shown in FIGS. 7A, the cylinder housing 26 may include a plurality of high-side pressure cavities 66A, 66B, 66C that define, at least in part the discharge volume 66. As discussed above, compressed refrigerant may exit the compression chamber 58 through orifice 90 (as controlled by reed mechanism 72). Refrigerant flows through the high-side pressure cavities 66A, 66B, 66C through the slots 96 in the direction of arrows 98 (see FIG. 7B). In the illustrated embodiment, the filter mounting aperture 102 is located above the inner high-side pressure cavity 66C. As shown, the outer shape of the magnetic debris filter 100 may match the shape of the filter mounting aperture 102. In one embodiment, the magnetic debris filter 100 is located between the cylinder housing 26 and the central housing 20 and held in place when the electric compressor 10 is assembled. In another embodiment, the magnetic debris filter 100 may be press-fit within the filter mounting aperture 102.

Figure 9A:
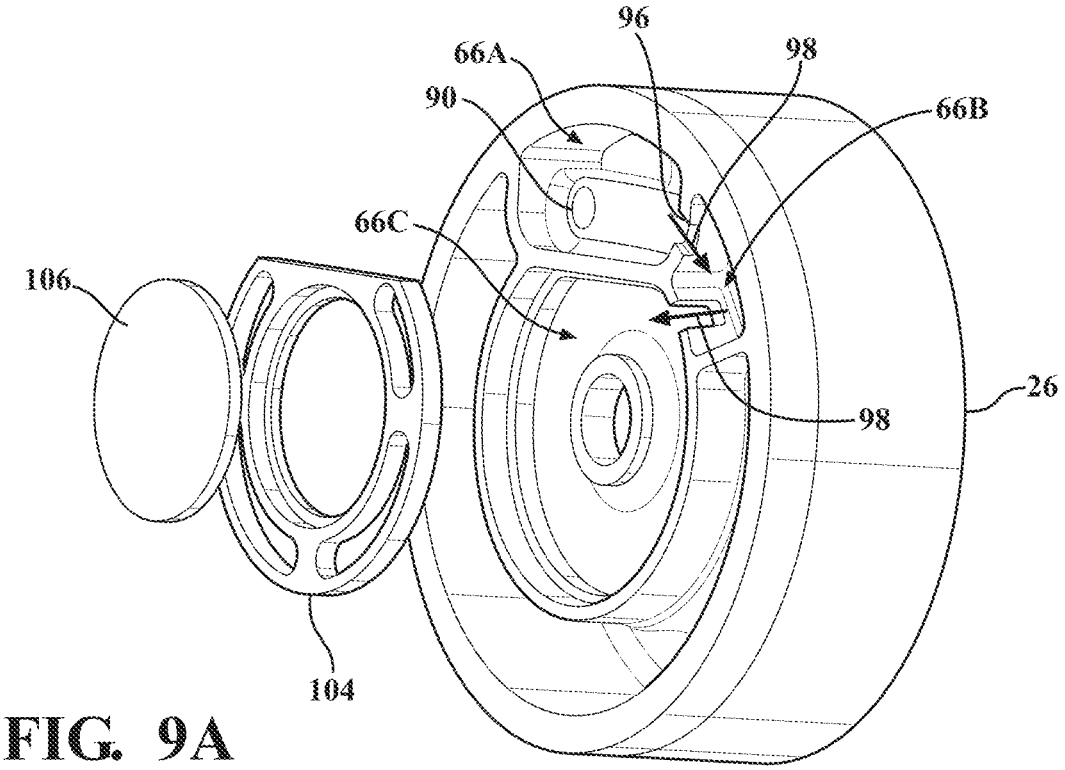
FIG. 9A is an exploded view of the compression device and magnetic debris filter of FIG. 8.
Figure 9B:
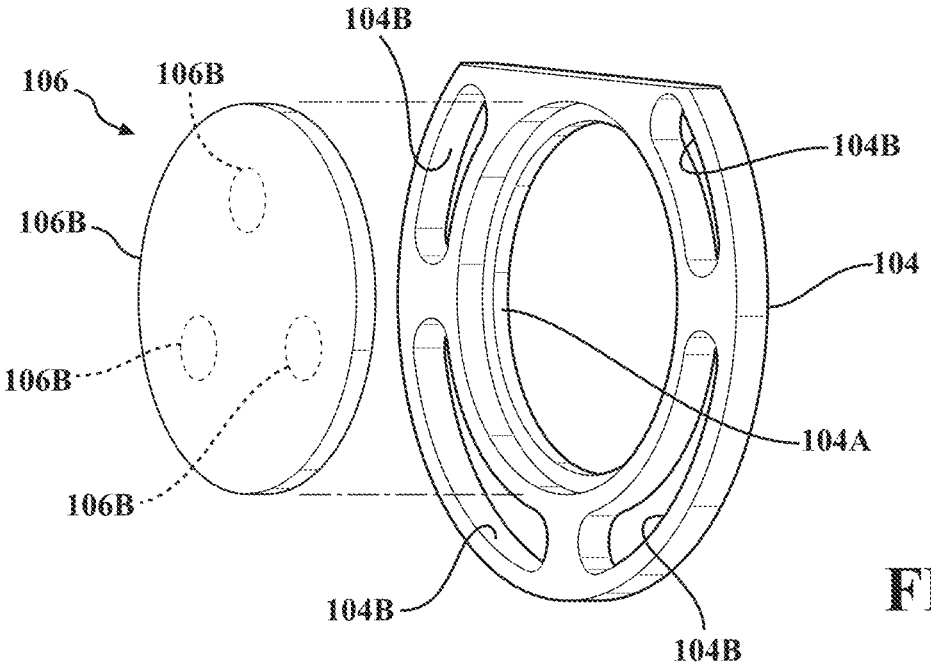
FIG. 9B is an exploded view of the magnetic debris filter assembly of FIG. 8.

With particular reference to FIGS. 9A-9B, the magnetic debris filter includes a filter frame 104 and a magnetic element 106. The filter frame 104 fits within the filter mounting aperture 102 and includes a magnet aperture 104A configured to receive the magnetic element 106. The filter mounting aperture 102 may also include one or more refrigerant apertures 104B. In the illustrated embodiment, compressed refrigerant enters the inner high-side pressure cavity 66C, debris, for example, iron debris, is captured by the magnetic element 106. The compressed refrigerant may then exit the inner high-side pressure cavity 66C through the one or more refrigerant apertures 104B.

In one embodiment of the present invention, the filter frame 104 may be composed from aluminum. The magnetic element 106 may be a magnet. Alternatively, the magnetic element 106 may include one more magnets 106A (shown in dotted lines in FIG. 9B) embedded in a substrate 106B.

Figure 10A:
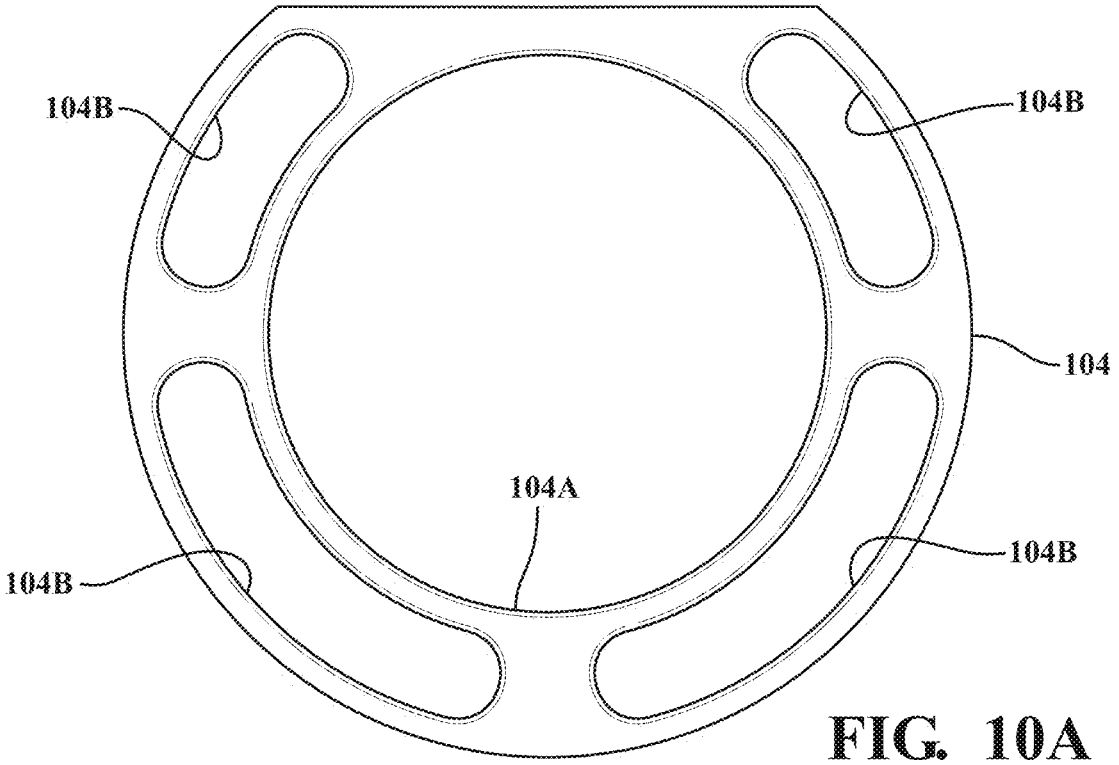
FIG. 10A is a front view of a filter frame of the magnetic debris filter assembly of FIG. 8, according to an embodiment of the present invention.
Figure 10B:
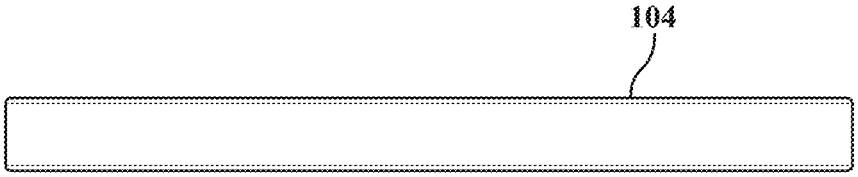
FIG. 10B is a side view of the filter frame of FIG. 10A.
Figure 10C:
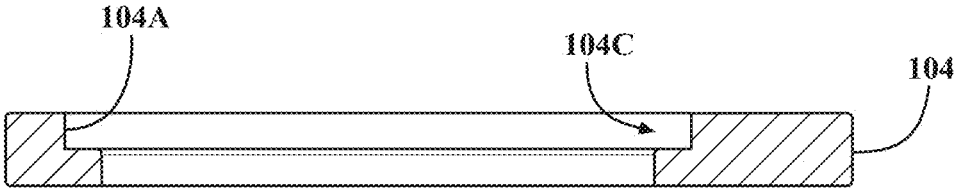
FIG. 10C is a cross-sectional view of the filter frame of FIG. 10A.

As shown in FIG. 10C, the magnet aperture 104A may be partially defined by a flange 104C. The magnetic element 106 may be retained within the magnet aperture 104A via a press-fit.

Spinning Disk Oil Separator

With particular reference to FIGS. 11A-11B and 12A-12B, in another aspect of the present invention, the electric compressor 10 may include an oil separator mechanism 110. The electric compressor 10 is configured to compress a refrigerant. As discussed above, in use, the refrigerant inside the electric compressor 10 may be a mixture of refrigerant and oil (for lubrication) which may be referred to as "refrigerant" or "refrigerant mixture" for simplicity. Prior to the compressed refrigerant exiting the electric compressor 10 through the outlet port 62, it is desirable to separate or substantially separate the oil from the refrigerant. The separated oil remains inside the housing 12 to provide lubrication to the moving components of the electric compressor 10.

As discussed above, the electric compressor 10 may include a housing 12, a refrigerant inlet port 60, a refrigerant outlet port 62, a drive shaft 44, and a compression device 18. The housing 12 defines an intake volume 64, and a discharge volume 66 and has a center axis 78. The housing 12 further defines a compression chamber 58. The refrigerant inlet port 60 is coupled to the housing 12 and is configured to introduce the refrigerant to the intake volume 64. The drive shaft 44 is located within the housing 12. The refrigerant outlet port 62 is coupled to the housing 12 and is configured to allow compressed refrigerant to exit the electric compressor 10 from the discharge volume 66. The compression device 18 is located within the compression chamber 58 and is coupled to the drive shaft 44. The compression device 18 is configured to receive the refrigerant from the intake volume 64 and compress the refrigerant as the drive shaft 44 is rotated. The housing 12, the compression device 18, and the compression chamber 58 define a refrigerant flow path 98 between the refrigerant inlet port 60 and the refrigerant outlet port 62.

Figure 11A:
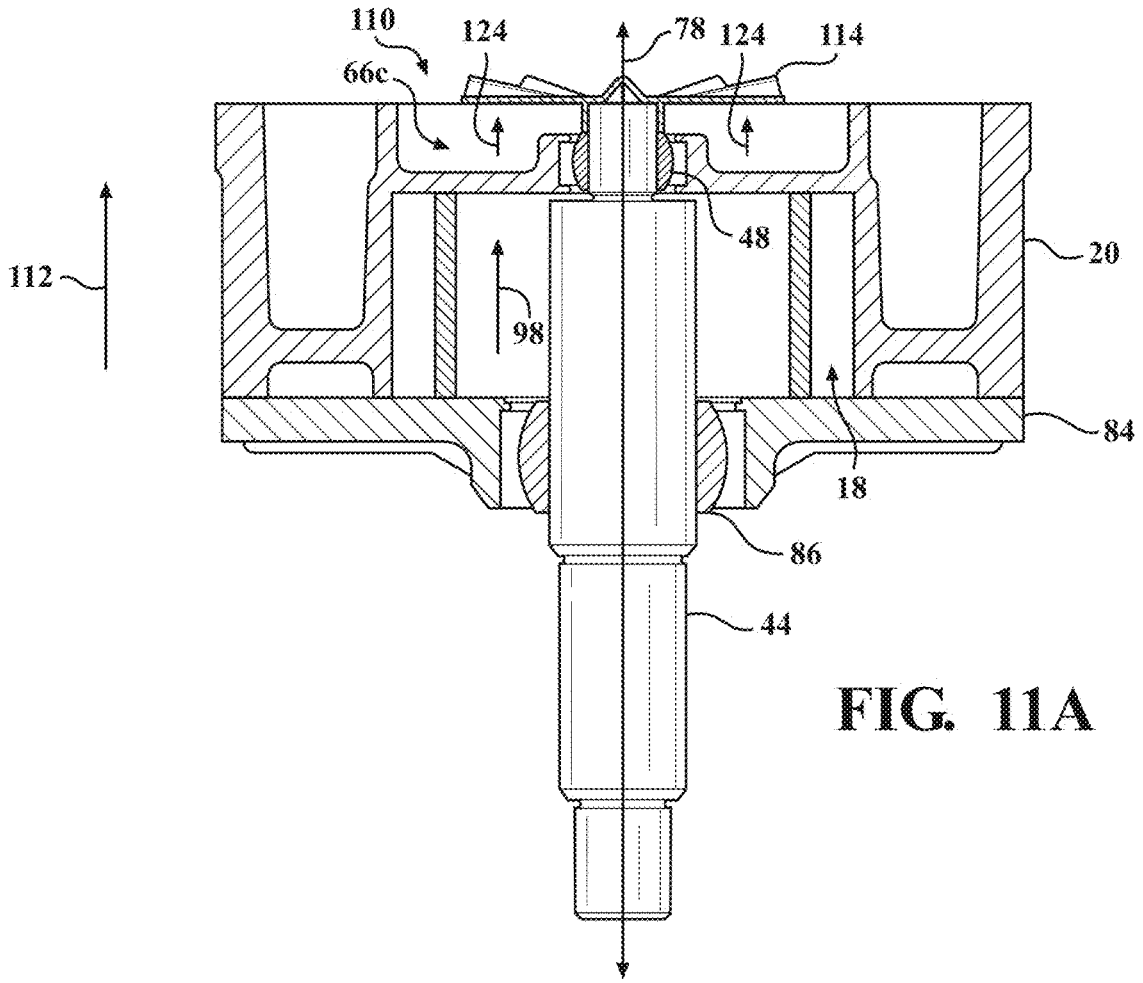
FIG. 11A is a cross-sectional view of a compression device for an electric compressor and an oil separator, according to an embodiment of the present invention.
Figure 11B:
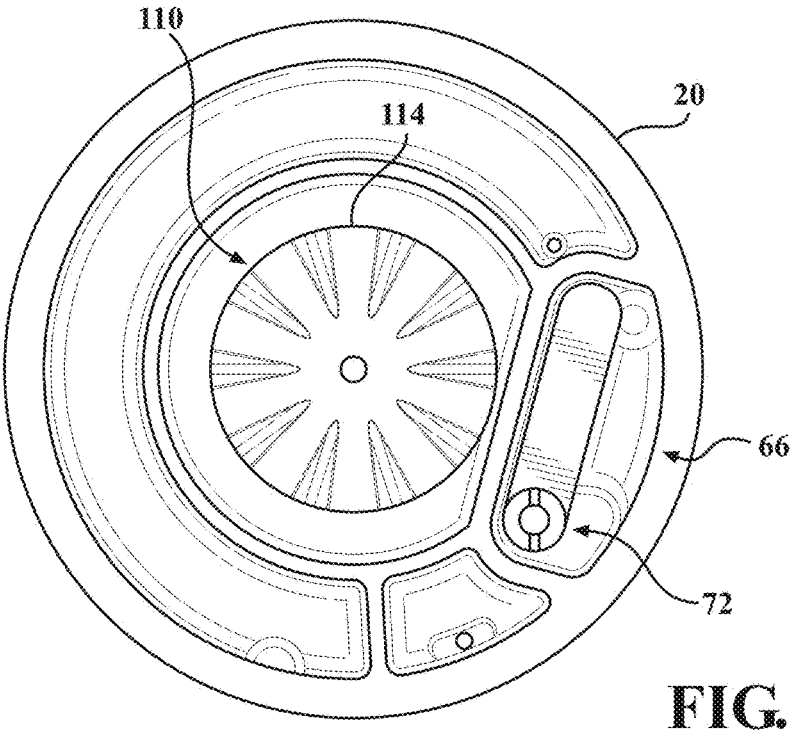
FIG. 11B is a front view of the compression device and oil separator of FIG. 11A.

With particular reference to FIGS. 11A-11B, in one embodiment the housing 12 includes the center housing 20 and the inner cover 84. The housing 12 may also include the rear head 24 (see FIGS. 1A-1B). The rear head 24 although not shown in FIG. 11A is adjacent and above the center housing 20.

In one aspect of the present invention, in operation the electric compressor 10 would be orientated vertically (as shown in FIG. 11A) with rear head 24 located at the top (indicated by arrow 112).

As shown, in the illustrated embodiment, the oil separator mechanism 110 includes a disk-shaped oil separator 114. The disk-shaped oil separator 114 has a center 116 and is coupled to the drive shaft 44 and is configured to be rotated therewith about the center 116. As shown, the disk-shaped oil separator 114 is located with the discharge volume 66. In the illustrated embodiment the disk-shaped oil separator 114 is located within the inner high-pressure cavity 66C. The oil separator mechanism 110 includes a flange 118 configured to fit over the upper end of the drive shaft 44. In one embodiment, the flange 118 is press-fit over the upper end of the drive shaft 44. In other embodiments, the oil separator mechanism 110 may be fastened to the upper end of the drive shaft 44 by any suitable means, for example, a fastener (not shown).

Figure 12A:
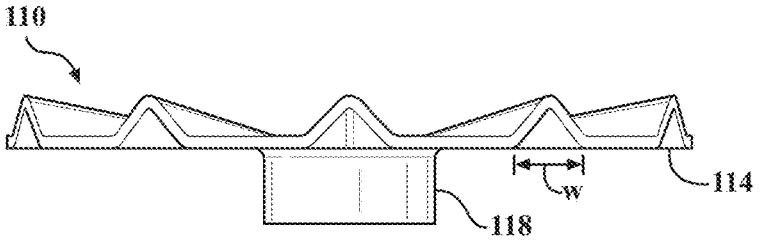
FIG. 12A is a side view of a disk of the oil separator of FIG. 11A, according to an embodiment of the present invention.
Figure 12B:
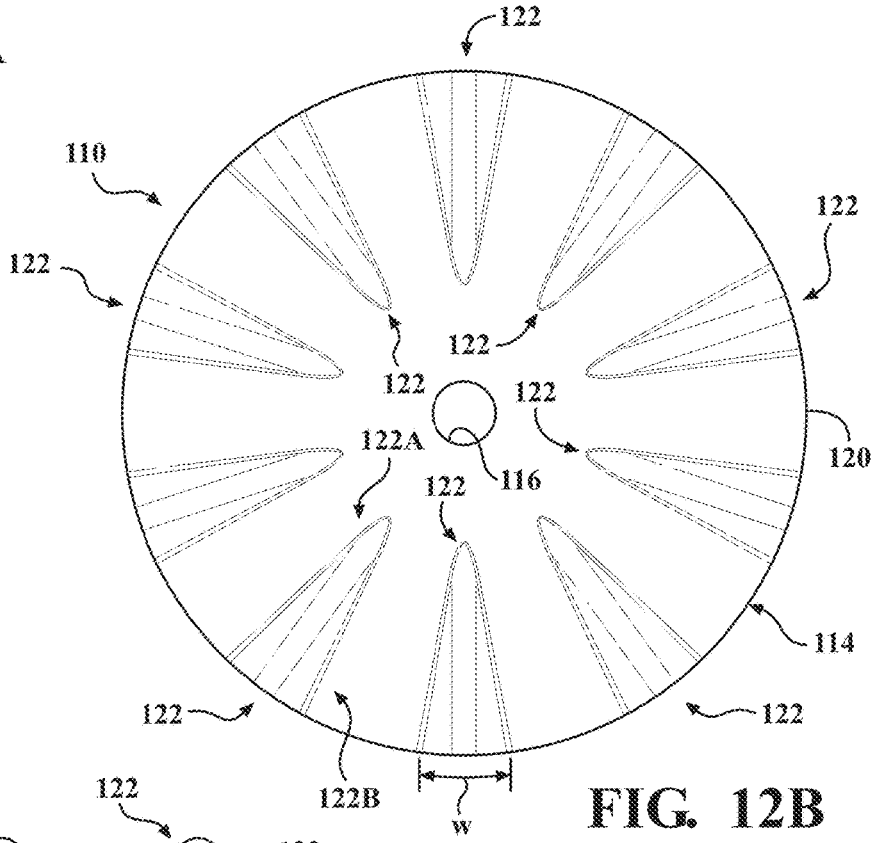
FIG. 12B is a top view of the disk of FIG. 11A.
Figure 12C:
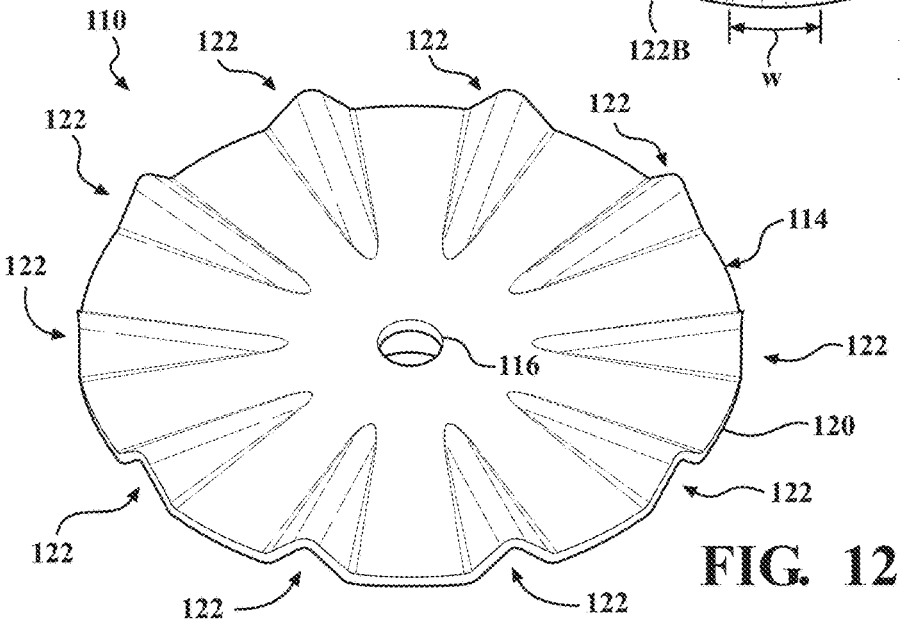
FIG. 12C is a perspective view of the disk of FIG. 11A.

With specific reference to FIGS. 12A-12C, the disk-shaped oil separator 114 has a continuous outer edge 120 and a plurality of trough-shaped features 122. Each trough-shaped feature 122 has a first end 122A and a second end 122B. The first end 122A is located adjacent the center 116 and extending outward towards the second end 122B. In the illustrated embodiment, the second end 122B of each trough-shaped feature 122 is located at the continuous outer edge 120 of the disk-shaped oil separator 114.

Each trough-shaped feature 122 has an associated width, w. In one aspect of the present invention, the width, w, increases as the trough-shaped feature 122 extends from the center 116 of the disk-shaped oil separator 114. The disk-shaped oil separator 114 may be composed from steel, a plastic, aluminum or other suitable material.

The oil separator mechanism 110 is configured to separate oil from the refrigerant prior the refrigerant being discharged. The refrigerant may be in the form of a gas and when mixed with the oil, the mixture may be immiscible due to high temperatures. In use, the oil separator 114 rotates with the drive shaft 44. As the compressed refrigerant/oil mixture enters the discharge volume 66 (or the inner high-pressure cavity 66C), the mixture is forced upward in direction of arrows 124. The rotating oil separator 114 and the trough-shaped features 122 disrupt the flow of the mixture. This interaction displaces the oil to the outer walls of the discharge chamber 66 and allows the oil to pool at the bottom of the discharge volume 66 and is then introduced to the low side of the compressor 10, i.e., the intake volume 64.

The above description describes multiple features of an electronic compressor, including but not limited to, a compression device with a rolling piston, a sub-assembly with integrated discharge chambers, a magnetic debris filter, and an oil separator. It should be noted that these features may be practice independently or jointly, in any combination.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed:

1. A compression device located within a compression chamber of an electric compressor, the electric compressor configured to compress a refrigerant and including a housing, a refrigerant inlet port, a refrigerant outlet port, a motor, and a drive shaft, the housing defining an intake volume and a discharge volume and having a center axis, the housing defines the compression chamber, the refrigerant inlet port coupled to the housing and configured to introduce the refrigerant to the intake volume, the refrigerant outlet port coupled to the housing and configured to allow compressed refrigerant to exit the electric compressor from the discharge volume, the motor mounted inside the housing, the drive shaft coupled to the motor and configured to rotate about the center axis, the compression device being coupled to the drive shaft and configured to receive the refrigerant from the intake volume and compressing the refrigerant as the drive shaft is rotated by the motor, the compression device including:

a piston device including a cylinder and a rolling piston and having a piston center axis, the piston center axis being offset from the center axis, the cylinder being eccentrically coupled to the drive shaft, the cylinder having a circular outer circumference, the rolling piston being tubular and concentric with the cylinder, the rolling piston having an outer surface in contact with an inner surface of the compression chamber, the rolling piston rotating about the cylinder as the drive shaft and the piston device is rotated by the motor, wherein the cylinder has an interior chamber configured to provide the cylinder with a rotational center of mass about the center axis; and, a vane moveably coupled to the housing and having an end adjacent the compression chamber, the vane being biased such that the end of the vane is in contact with the rolling piston as the piston device is rotated by the drive shaft, the housing, piston device, and the vane forming variable sub-chambers within the compression chamber as the piston device is rotated within the compression chamber, wherein refrigerant enters one of the sub-variable sub-chambers from the intake volume, is compressed as the piston device is rotated, and exits the one of the sub-chambers into the discharge volume.

2. The compression device, as set forth in claim 1, wherein the cylinder is keyed to the drive shaft via an interference fit.

3. The compression device, as set forth in claim 1, wherein the housing includes a vane slot, the vane being slidably positioned within the vane slot.

4. The compression device, as set forth in claim 3, the vane slot being connected to the discharge volume, the vane being biased towards the piston device by refrigerant within the discharge volume.

5. The compression device, as set forth in claim 3, the housing including a cylinder housing, the vane slot being located within the cylinder housing.

6. The compression device, as set forth in claim 5, the cylinder housing including an internal suction port coupled between the compression chamber and the intake volume and an internal discharge chamber coupled between the compression chamber and the discharge volume, the compression device further including a reed device coupled to the cylinder housing configured to control the release of pressurized refrigerant from the compression chamber via the internal discharge chamber.

7. An electric compressor configured to compress a refrigerant, comprising:

a housing defining an intake volume and a discharge volume and having a center axis, the housing further defining a compression chamber;

a refrigerant inlet port coupled to the housing and configured to introduce the refrigerant to the intake volume;

a refrigerant outlet port coupled to the housing and configured to allow compressed refrigerant to exit the electric compressor from the discharge volume; and, a compression device located within the compression chamber and being coupled to a drive shaft having a center axis, the compression device configured to receive the refrigerant from the intake volume and to compress the refrigerant as the drive shaft is rotated, the compression device including:

a piston device including a cylinder and a rolling piston and having a piston center axis, the piston center axis being offset from the center axis, the cylinder being eccentrically coupled to the drive shaft, the cylinder having a circular outer circumference, the rolling piston being tubular and concentric with the cylinder, the rolling piston having an outer surface in contact with an inner surface of the compression chamber, the rolling piston rotating about the cylinder as the drive shaft and the piston device is rotated by the motor, wherein the cylinder has an interior chamber configured to provide the cylinder with a rotational center of mass about the center axis; and, a vane moveably coupled to the housing and having an end adjacent the compression chamber, the vane being biased such that the end of the vane is in contact with the rolling piston as the piston device is rotated by the drive shaft, the housing, piston device, and the vane forming variable sub-chambers within the compression chamber as the piston device is rotated within the compression chamber, wherein refrigerant enters one of the sub-variable sub-chambers from the intake volume, is compressed as the piston device is rotated, and exits the one of the sub-chambers into the discharge volume.

8. An electric compressor configured to compress a refrigerant, comprising:

a housing defining an intake volume and a discharge volume and having a center axis, the housing further defining a compression chamber;

a refrigerant inlet port coupled to the housing and configured to introduce the refrigerant to the intake volume;

a refrigerant outlet port coupled to the housing and configured to allow compressed refrigerant to exit the electric compressor from the discharge volume;

a motor mounted inside the housing;

a drive shaft coupled to the motor and configured to rotate about the center axis; and, a compression device located within the compression chamber and being coupled to the drive shaft, the compression device configured to receive the refrigerant from the intake volume and compressing the refrigerant as the drive shaft is rotated by the motor, the compression device including:

a piston device including a cylinder and a rolling piston and having a piston center axis, the piston center axis being offset from the center axis, the cylinder being eccentrically coupled to the drive shaft, the cylinder having a circular outer circumference, the rolling piston being tubular and concentric with the cylinder, the rolling piston having an outer surface in contact with an inner surface of the compression chamber, the rolling piston rotating about the cylinder as the drive shaft and the piston device is rotated by the motor, wherein the cylinder has an interior chamber configured to provide the cylinder with a rotational center of mass about the center axis; and, a vane moveably coupled to the housing and having an end adjacent the compression chamber, the vane being biased such that the end of the vane is in contact with the rolling piston as the piston device is rotated by the drive shaft, the housing, piston device, and the vane forming variable sub-chambers within the compression chamber as the piston device is rotated within the compression chamber, wherein refrigerant enters one of the sub-variable sub-chambers from the intake volume, is compressed as the piston device is rotated, and exits the one of the sub-chambers into the discharge volume.

9. The electric compressor, as set forth in claim 8, wherein the housing includes a cylinder housing and a rear head, the discharge volume being formed, at least partially, by the cylinder housing, the rear head, and the refrigerant outlet port.

10. The electric compressor, as set forth in claim 9, wherein the housing includes an inverter cover and a central housing, the central housing and the inverter cover forming an inverter cavity, the electric compressor further including an inverter module mounted inside the inverter cavity and configured to convert direct current electrical power to alternating current electrical power.

11. The electric compressor, as set forth in claim 10, the housing includes a first drive shaft supporting member and a second drive shaft supporting member.

12. The electric compressor, as set forth in claim 11, further including first and second ball bearings located within the first and second drive shaft supporting members configured to receive respective ends of the drive shaft.

13. The electric compressor, as set forth in claim 8, wherein the cylinder is keyed to the drive shaft via an interference fit.

14. The electric compressor, as set forth in claim 8, wherein the housing includes a vane slot, the vane being slidably positioned within the vane slot.

15. The electric compressor, as set forth in claim 14, the vane slot being connected to the discharge volume, the vane being biased towards the piston device by refrigerant within the discharge volume.

16. The electric compressor, as set forth in claim 14, the housing including a cylinder housing, the vane slot being located within the cylinder housing.

17. The electric compressor, as set forth in claim 16, the cylinder housing including an internal suction port coupled between the compression chamber and the intake volume and an internal discharge chamber coupled between the compression chamber and the discharge volume, the compression device further including a reed device coupled to the cylinder housing configured to control the release of pressurized refrigerant from the compression chamber via the internal discharge chamber.

18. The electric compressor, as set forth in claim 16, the cylinder housing includes a lip to assist in properly positioning the rolling piston relative to the cylinder housing.

19. The electric compressor, as set forth in claim 16, further including an inner cover configured to be positioned within central housing adjacent a flange of the central housing.

20. The electric compressor as set forth in claim 19, the inner cover third drive shaft including a third drive shaft supporting member.

21. The electric compressor, as set forth in claim 20, further including a third ball bearing located within the third drive shaft supporting member configured to receive the drive shaft.

22. An electric compressor configured to compress a refrigerant, comprising:

a housing defining an intake volume and a discharge volume and having a center axis, the housing including a central housing, a cylinder housing, a rear head, and an inverter cover, the central housing and the inverter cover forming an inverter cavity, the cylinder housing forming a compression chamber and having a vane slot connected to the discharge volume;

a refrigerant inlet port coupled to the housing and configured to introduce the refrigerant to the intake volume;

a refrigerant outlet port coupled to the housing and configured to allow compressed refrigerant to exit the electric compressor from the discharge volume, the discharge volume being formed, at least partially, by the central housing, the rear head, and the refrigerant outlet port;

a motor mounted inside the housing;

an inverter module mounted inside the inverter cavity and configured to convert direct current electrical power to alternating current electrical power;

a drive shaft coupled to the motor and configured to rotate about the center axis; and, a compression device located within the compression chamber and being coupled to the drive shaft, the compression device configured to receive the refrigerant from the intake volume and compressing the refrigerant as the drive shaft is rotated by the motor, the compression device including:

a piston device including a cylinder and a rolling piston and having a piston center axis, the piston center axis being offset from the center axis, the cylinder being eccentrically coupled to the drive shaft, the cylinder having an interior chamber configured to provide the cylinder with a rotational center of mass about the center axis, the cylinder having a circular outer circumference, the rolling piston being tubular and concentric with the cylinder, the rolling piston having an outer surface in contact with an inner surface of the compression chamber, the rolling piston rotating about the cylinder as the drive shaft and the piston device is rotated by the motor; and, a vane within the vane slot and having an end adjacent the compression chamber, the vane being biased towards the piston device by refrigerant within the discharge volume such that the end of the vane is in contact with the rolling piston as the piston device is rotated by the drive shaft, the housing, piston device, and the vane forming variable sub-chambers within the compression chamber as the piston device is rotated within the compression chamber, wherein refrigerant enters one of the sub-variable sub-chambers from the intake volume, is compressed as the piston device is rotated, and exits the one of the sub-chambers into the discharge volume.

* * * * *